US007901294B2

(12) United States Patent
Walker et al.

(10) Patent No.: US 7,901,294 B2
(45) Date of Patent: Mar. 8, 2011

(54) METHOD AND APPARATUS FOR ENABLING A PLAYER TO SIMULTANEOUSLY CONTROL GAME PLAY ON MULTIPLE GAMING DEVICES

(75) Inventors: Jay S. Walker, Ridgefield, CT (US); Robert C. Tedesco, Fairfield, CT (US); James A. Jorasch, New York, NY (US); Daniel E. Tedesco, Huntington, CT (US); Michael W. Patterson, New York, NY (US)

(73) Assignee: IGT, Reno, NV (US)

( * ) Notice: Subject to any disclaimer, the term of this patent is extended or adjusted under 35 U.S.C. 154(b) by 1146 days.

(21) Appl. No.: 11/361,757

(22) Filed: Feb. 24, 2006

(65) Prior Publication Data

US 2006/0160614 A1 Jul. 20, 2006

(51) Int. Cl.
*A63F 9/24* (2006.01)

(52) U.S. Cl. ..... 463/42; 463/25; 463/27; 463/29; 463/30

(58) Field of Classification Search ..... 463/25, 463/29, 30, 42, 27
See application file for complete search history.

(56) References Cited

U.S. PATENT DOCUMENTS

| | | | | |
|---|---|---|---|---|
| 4,448,419 | A * | 5/1984 | Telnaes | 463/21 |
| 4,467,424 | A | 8/1984 | Hedges et al. | 364/412 |
| 4,926,327 | A | 5/1990 | Sidley | 364/412 |
| 5,116,055 | A | 5/1992 | Tracy | 273/138 A |
| 5,159,549 | A | 10/1992 | Hallman, Jr. et al. | 364/412 |
| 5,178,390 | A | 1/1993 | Okada | 273/143 R |
| 5,259,613 | A | 11/1993 | Marnell, II | 273/138 A |
| 5,275,400 | A | 1/1994 | Weingardt et al. | 273/85 CP |
| 5,324,035 | A | 6/1994 | Morris et al. | 273/138 A |
| 5,377,973 | A | 1/1995 | Jones et al. | 273/85 CP |
| 5,390,934 | A | 2/1995 | Grassa | 273/292 |
| 5,395,242 | A | 3/1995 | Slye et al. | 434/43 |
| 5,397,128 | A | 3/1995 | Hesse et al. | 273/292 |
| 5,411,258 | A | 5/1995 | Wilson et al. | 273/86 B |
| 5,472,194 | A | 12/1995 | Breeding et al. | 273/138 A |
| 5,564,700 | A | 10/1996 | Celona | 463/27 |
| 5,570,885 | A | 11/1996 | Ornstein | 463/27 |
| 5,580,309 | A | 12/1996 | Piechowiak et al. | 463/16 |
| 5,593,349 | A | 1/1997 | Miguel et al. | 463/30 |
| 5,611,730 | A | 3/1997 | Weiss | |
| 5,639,088 | A | 6/1997 | Schneider et al. | 273/138.2 |
| 5,655,961 | A | 8/1997 | Acres et al. | 463/27 |

(Continued)

FOREIGN PATENT DOCUMENTS

GB 2 161 008 A 1/1986

(Continued)

OTHER PUBLICATIONS

"Revealing the Casinos Best-Kept Secrets—Hot Slots & Reel Deals", Atlantic City Insider, Oct. 1996, vol. 1, No. 2.

(Continued)

*Primary Examiner* — Pierre E Elisca
(74) *Attorney, Agent, or Firm* — K&L Gates LLP

(57) ABSTRACT

In accordance with at least one embodiment, a gaming system is operable to determine a first gaming device being operated by a player and select a second gaming device to be controlled, via the first gaming device, by the player. In some embodiments, the gaming system is further operable to configure the second gaming device to be controlled via an interface of the first gaming device.

36 Claims, 10 Drawing Sheets

U.S. PATENT DOCUMENTS

| | | | | |
|---|---|---|---|---|
| 5,707,286 | A * | 1/1998 | Carlson | 463/16 |
| 5,722,891 | A | 3/1998 | Inoue | 463/20 |
| 5,770,533 | A | 6/1998 | Franchi | 463/42 |
| 5,890,962 | A | 4/1999 | Takemoto | 463/20 |
| 5,947,820 | A | 9/1999 | Morro et al. | 463/9 |
| 5,984,779 | A | 11/1999 | Bridgeman et al. | |
| 6,001,016 | A | 12/1999 | Walker et al. | 463/42 |
| 6,012,982 | A | 1/2000 | Piechiowiak et al. | 463/16 |
| 6,024,642 | A | 2/2000 | Stupak | 463/20 |
| 6,033,307 | A * | 3/2000 | Vancura | 463/20 |
| 6,039,648 | A * | 3/2000 | Guinn et al. | 463/16 |
| 6,077,162 | A | 6/2000 | Weiss | 463/26 |
| 6,159,095 | A | 12/2000 | Frohm et al. | 463/19 |
| 6,190,255 | B1 * | 2/2001 | Thomas et al. | 463/20 |
| 6,254,481 | B1 * | 7/2001 | Jaffe | 463/20 |
| 6,264,561 | B1 | 7/2001 | Saffari et al. | |
| 6,270,412 | B1 | 8/2001 | Crawford et al. | 463/20 |
| 6,361,441 | B1 | 3/2002 | Walker et al. | 463/42 |
| 6,461,241 | B1 | 10/2002 | Webb et al. | 463/20 |
| 6,652,378 | B2 * | 11/2003 | Cannon et al. | 463/20 |
| 6,832,957 | B2 | 12/2004 | Falconer | 463/20 |
| 6,837,788 | B2 | 1/2005 | Cannon | 463/16 |
| 6,991,538 | B2 | 1/2006 | Cannon | |
| 7,341,518 | B2 | 3/2008 | Muskin | |
| 2002/0025850 | A1 | 2/2002 | Hafezi | |
| 2002/0077167 | A1 * | 6/2002 | Merari | 463/13 |
| 2003/0027628 | A1 | 2/2003 | Luciano | 463/20 |
| 2004/0043815 | A1 * | 3/2004 | Kaminkow | 463/25 |
| 2004/0087369 | A1 | 5/2004 | Tanaka et al. | |
| 2004/0152509 | A1 * | 8/2004 | Hornik et al. | 463/20 |
| 2005/0107158 | A1 | 5/2005 | Kanisawa et al. | |
| 2010/0016062 | A1 * | 1/2010 | Baerlocher | 463/20 |

FOREIGN PATENT DOCUMENTS

| | | |
|---|---|---|
| WO | WO 99/10849 | 3/1999 |
| WO | WO 01/82245 | 1/2001 |
| WO | WO 02/099760 | 12/2002 |
| WO | WO 2005/079242 | 9/2005 |

OTHER PUBLICATIONS

Website: "CC&GTCC 3rd Annual Championship Poker Challenge during the CC&GTCC Convention", (http //www ccgtcc com/poker2001 htm), May 31, 2001.

Website: "Money Time at Casino Windsor", (http //www casinowindsor com/casino/slots/moneytimehtm), download date: Jul. 25, 2001.

Fine, Adam, "Players Network Gaming Guide Article—Big River", The Casino Player, (http//wwwplayersnetwork.com/travel/articles/big-river 001,0005.html), download date Jul. 25, 2001.

Website: "Casino Circle! Presents $$$ Free $$$ Online Slot Tournaments and other Choice Online Casino Games of Chance, Luck and Skill that Pay-Off!", (http//www.sidewalkshoppes.com/slots_free_tournaments html) download date: Jul. 26, 2001.

Website: "Casinos featuring Slot Tournaments in Las Vegas—Slot Tournaments and how they work". (http www.interexna.com/tournaments.html, download date Jul. 26, 2001.

Website: "gameland.com", (http www gameland com/home/), download date: Sep. 5, 2001.

Office Action for U.S. Appl. No. 11/428885 dated Jul. 23, 2008, 15pp.

* cited by examiner

400

| PLAYER ID 410 | SOCIAL SECURITY NUMBER 412 | NAME 414 | ADDRESS 416 | PHONE NUMBER 418 | CREDIT CARD NUMBER 420 |
|---|---|---|---|---|---|
| 123456 | 123-45-7890 | BILL GREEN | 111 NORTH AVE. | (212) 555-1234 | 1111-2222-3333-4444 |
| 876543 | 876-54-3210 | ROB BLUE | 423 SOUTH ST. | (812) 555-4321 | 2222-4444-6666-8888 |
| 158595 | 555-12-6338 | KAREN RED | 64 WEST RD. | (315) 555-5954 | 1111-3333-5555-7777 |

| CREDIT BALANCE 422 | (ACCUMULATED) COMP. POINTS 424 | HOTEL GUEST 426 | PLAYER RATING 428 | CASINO ACCOUNT 430 | BANK ACCOUNT 432 |
|---|---|---|---|---|---|
| $25.00 | 130 PTS. | NO | 4 | $15.54 | NONE |
| $17.50 | 240 PTS. | YES | 2 | NONE | NONE |
| $0.00 | 350 PTS. | YES | 2 | $150.00 | ACCT.# 54376... |

FIG. 4

METHOD AND APPARATUS FOR ENABLING A PLAYER TO SIMULTANEOUSLY CONTROL GAME PLAY ON MULTIPLE GAMING DEVICES

FIELD

Various embodiments are described that generally relate to gaming devices and more specifically, but not exclusively, to allowing a player to simultaneously control multiple gaming devices to receive multiple game outcomes.

BRIEF DESCRIPTION OF THE DRAWINGS

FIG. 4 is a table illustrating an exemplary embodiment of a player tracking database with exemplary entries.

DETAILED DESCRIPTION

Figure 1:
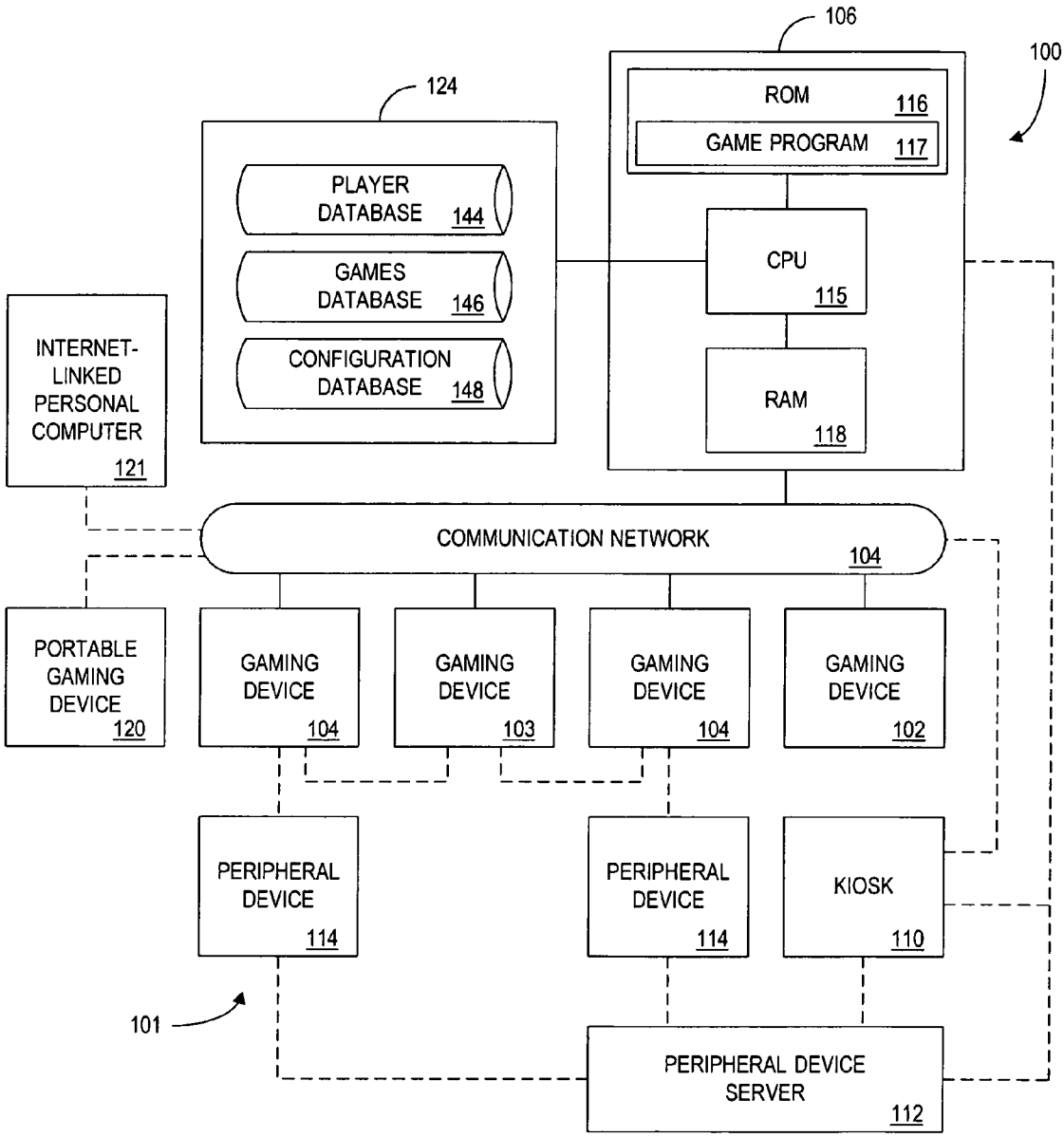
FIG. 1 is an overall schematic illustration of one embodiment of a network of gaming devices.

Described herein are novel methods and systems for enabling a player to control two or more gaming devices simultaneously (or at approximately the same time). Gaming devices, and in particular slot type and video type poker gaming devices have become one of the predominant forms of wagering. These gaming devices are typically located individually or in banks on the gaming establishment floor.

Some players will establish a credit balance on an adjacent gaming device and play two gaming devices simultaneously. This requires some dexterity on the part of the player who must either stretch to at least one of the gaming devices, or, situate themselves, sometimes uncomfortably, between two gaming devices. Some players may take this simultaneous game play a step further, and play three gaming devices simultaneously. The player is generally situated at the center gaming device and stretches to either side to reach the adjacent gaming devices. This presents an uncomfortable posture for the player.

Further drawbacks exist for players attempting to play more than one gaming device simultaneously (or substantially simultaneously) prior to Applicants invention described herein. For example, the ability of the player to claim the right to play (or prevent another from playing) a gaming device at which the player is not directly sitting is left to the somewhat ambiguous vagaries of casino etiquette. Some players will physically cordon off several gaming devices. Other players may simply position themselves and their belongings to obstruct other players from easily gaining physical access to the claimed gaming devices. Regardless, of the method used, neither of these methods provides players with any certainty over the possession of their claimed gaming devices. In addition, collecting payouts from several gaming devices may become more problematic as the player's attention may be diverted, creating a security issue. Furthermore, misunderstandings between players claiming control and those seeking control may lead to social conflict. Further, some players may wish to play gaming devices that are not adjacent and simply do not allow simultaneous play because of physical distance.

Accordingly, described herein are novel methods and systems for enabling players to comfortably and securely play multiple gaming devices simultaneously (or at approximately the same time). Such methods and systems allow a player to securely establish the right to control multiple gaming devices and receive payouts of winning game outcomes from these gaming devices. Further, the novel methods and systems enable a player to play multiple gaming devices irrespective of the proximity of the gaming devices to one another.

In one embodiment, a gaming device or a plurality of gaming devices are configured to allow a player to simultaneously (e.g., at approximately the same time) operate, play and/or control multiple gaming devices from a single gaming device or from another device (e.g., a kiosk, portable device, etc.). In one embodiment, the gaming devices may be adjacent to one another and/or may be in a bank of gaming devices in communication with a particular controller or server. In one embodiment, a server in a computer network (comprising a plurality of gaming devices) is used to provide the necessary communication links (i) between gaming devices selected to be operated, controlled and/or played simultaneously and/or (ii) between the gaming devices and the server device to control functions necessary to produce game outcomes from each of the selected gaming devices. The gaming devices to be operated, controlled and/or played simultaneously may be selected, for example, by a player and/or on behalf of a player. Messages, in one embodiment, are relayed from the controlling gaming device to a controlled gaming device to produce game outcomes from each of the controlled gaming devices. In another embodiment, a player may select gaming devices from anywhere in the gaming establishment for simultaneous game play—the controlled gaming devices not requiring to be adjacent to the controlling gaming device.

The explanation of the selection and control of selected gaming devices by and/or on behalf of the player to allow simultaneous play of multiple gaming devices begins with a description, in accordance with one embodiment, of the gaming devices and the network on which the gaming devices may operate.

Referring now to FIG. 1, illustrated therein is an example embodiment of a gaming network 100 that may be used to implement one or more embodiments generally described herein. The gaming network 100 of FIG. 1 includes a plurality of network devices 101 that are directly or indirectly in communication with the gaming network 100 to accept wagers, determine game outcomes, and provide payouts for winning game outcomes. Among these network devices 101 are a gaming server 106 (that is in communication with one or more other network devices), a gaming device 102 (e.g., video slot machines, video poker machines, mechanical reel slot machines), a kiosk 110, a merchant point-of-sale (POS)

terminal (not shown), a peripheral device server 112, various component devices (e.g., display screens) (not shown), various peripheral devices 114 associated with the gaming device (e.g., card readers), a portable gaming device 120 (e.g., a PDA or cell phone), and an Internet linked personal computer 121. These devices and their functions are described in detail below.

Each gaming device 102, and every other network device 101 in the gaming network 100 that communicates with another network device in the gaming network, is uniquely identified by a device identification (ID) number, to allow communication with the gaming server 106 via the gaming network 100. The gaming network 100 may communicate with devices directly or indirectly, via a wired or wireless medium to a communication network 104 such as the Internet, LAN, WAN or Ethernet, Token Ring, or via any appropriate communications means or combination of communications means. It is to be understood, however, that other arrangements in which the gaming devices 102 communicate with the server 106 are also possible.

In one embodiment, one gaming device 102 may be directly controlled by a player (i.e., controlling gaming device 103) which controls at least one other gaming device 102 either directly or indirectly (i.e., controlled gaming device 104). The controlling gaming device 103 may use several different communication methods to establish, open, activate, or initiate a link between the controlling gaming device 103 and the controlled gaming device 104. Of course, in other embodiments, no such link may be necessary. For example, the controlled gaming device 104 may be controlled by gaming server 106 or by another device, in response to a communication from controlling gaming device 103 that a player operating controlling gaming device 103 desires to also control, operate or play controlled gaming device 104. In such an embodiment, the controlled gaming device 103 may not actually or directly control the controlled gaming device 104. Rather, gaming server 106 may control the controlled gaming device 104 on behalf of the player operating, controlling or playing the controlling gaming device 103.

In accordance with some embodiments, two gaming devices 102 may communicate in a virtual peer-to-peer communication network established by the gaming server 106. Although the communication between gaming devices 102 may occur through the gaming server 106, the process appears to be a peer-to-peer communication process.

Alternatively, the network may establish true peer-to-peer communications between gaming devices. Gaming devices 102 may include a unique communication identifier allowing such devices to communicate directly with each other using any number of available communication protocols, public or private.

For example, a variety of communications protocols may be part of the system, including but not limited to: Ethernet (or IEEE 802.3), SAP, SAS, SUPERSAS, ATP, BLUETOOTH, and TCP/IP. Further, in some embodiments, various communications protocols endorsed by the Gaming Standards Association of Fremont, Calif., may be utilized, such as (i) the Gaming Device Standard (GDS), which may facilitate communication between a gaming device 102 and various component devices and/or peripheral devices 114 (e.g., printers, bill acceptors, etc.), (ii) the Best of Breed (BOB) standard, which may facilitate communication between a gaming device 102 and various servers 106 related to play of one or more gaming devices (e.g., servers that assist in providing accounting, player-tracking, content management, ticket-in/ticket-out and progressive jackpot functionality), and/or (iii) the System-to-System (S2S) standard, which may facilitate communication between game-related servers 106 and/or casino property management servers (e.g., a hotel server comprising one or more databases that store information about booking and reservations). Communication may be encrypted to ensure privacy and prevent fraud in any of a variety of ways well known in the art.

The gaming device 102 may be implemented as a system server, a dedicated hardware circuit, an appropriately programmed general-purpose computer, or any other equivalent electronic, mechanical, or electromechanical device. The gaming device 102 may comprise any or all of the gaming devices of the aforementioned systems.

In some embodiments, a gaming device 102 may comprise a portable gaming device 120—for example, a portable or "handheld" gaming device (e.g., a device similar to a PDA) or a cell phone that may be used in place of, or in addition to, some or all of the gaming device and/or its components. The portable gaming device 120 may be used to view "walk away" game outcomes from a gaming device 102. Methods for viewing walk away game outcomes are described in Applicants' U.S. Pat. No. 6,012,983, filed Dec. 30, 1996, entitled "AUTOMATED PLAY GAMING DEVICE" and U.S. Pat. No. 6,964,611, filed Aug. 15, 2001 entitled "SYSTEM AND METHOD FOR AUTOMATED PLAY OF LOTTERY GAMES" the entirety of each are incorporated herein by reference for all purposes.

In this situation, the portable gaming device 120 may be in communication with the gaming device 102 and/or gaming server 106 in the gaming network 100. Game outcomes may be generated by the gaming device 102 and communicated to the player on the portable gaming device 120 (e.g., directly or via gaming server 106). In one embodiment, a player may be able to control a plurality of gaming devices 102 via a portable gaming device 120. For example, portable gaming device 120 may be a controlling gaming device 103 and a plurality of gaming devices 102 may be controlled gaming devices 104. In one embodiment of a central determination system, game outcomes from the server 106 may be communicated directly to the player's portable gaming device 120. Either system allows the player the convenience of receiving and viewing game outcomes anywhere in the gaming establishment Further, a gaming device 102 may comprise an Internet linked personal computer 121 that may be operable to communicate with an online casino and facilitate game play at the online casino. In one embodiment, the Internet linked personal computer 121 may receive game outcomes produced by a gaming device 102 in the gaming establishment similar to the portable gaming device 120 described above. In one embodiment, the gaming server 106 communicates the game outcomes received from a player's gaming devices 102 to the player's personal computer 121.

The peripheral device server 112 may be available to provide additional communication capabilities between peripheral devices 114 in the gaming network 100. These peripheral devices 114 may include player-tracking devices, additional screen displays, ticket readers and printers, etc.

In some embodiments, a kiosk 110 may be configured to execute or assist in the execution of various processes of the gaming network 100. In some embodiments, a kiosk 110 may comprise a processor and a memory. A kiosk 100 may also comprise various input devices (e.g., a keypad, a keyboard, a mouse, pushbuttons, a port that receives player tracking cards, an optical scanner for reading bar codes or other indicia, a CCD camera, etc.), output devices (e.g., a display screen, audio speakers, etc.), benefit output devices (e.g., a coin tray or printer for printing ticket tickets), combinations thereof (e.g., a "in/ticket-out" device, a touch-sensitive display screen, etc.), communications ports, and so on. Thus, a kiosk 110 may comprise many of the features and components of a gaming device 102, though the kiosk itself may not necessarily be configured to enable gaming activity as a primary function. A kiosk may communicate with any or all of (i) a gaming server 106, (ii) a gaming device 102, (iii) an inventory/reservation system of a casino-maintained property (e.g., a hotel), (iv) casino personnel devices, (v) merchant POS terminals, and so on. A number of kiosks 110 may be stationed within casino premises (e.g., at various locations on a slot floor). In one embodiment, a player may be enabled to control, operate, and/or play a plurality of gaming devices 102 via a kiosk 110.

In various embodiments, kiosks may execute or assist in the execution of (i) determining and outputting a player status or other types of data described herein (e.g., a kiosk receives a player tracking card, and provides a description of the player's redeemable awards), (ii) outputting payments to players (e.g., upon receipt of cash-less gaming vouchers, player tracking cards, account identifiers, smart cards, etc.), (iii) receiving "deposits" of funds from players to be stored in an account (e.g., casino account, financial account), (iv) transferring balances from one type of account to another type of account, and/or (v) any other process described herein. Thus, such a device may be configured to read from and/or write to one or more databases. The memory of such a device may store a program for executing such processes.

The kiosk 110 may be available for allowing a player to customize the gaming experience or cash out game winnings (e.g., retrieve winnings from an account). The kiosk 110 may also be available to the player for purchasing flat-rate gaming sessions, purchasing goods and services with player loyalty points.

The gaming device 102, the kiosk 110, and the peripheral device server 112 as well as all other network devices 101 are in communication with the gaming server. The gaming server 106 will now be described in detail with reference to FIG. 1. Like the gaming device 102, the gaming server 106 has a central processing unit CPU 115. The server executes the instructions of a program 117 stored in Read Only Memory (ROM) 116 and executed from Random Access Memory RAM 118. Additionally, the CPU 115 is coupled to a data storage device 124, having a plurality of databases.

In order to communicate with gaming devices 102 and/or another device, the gaming server 106 also includes a communication port. The communication port connects the server's CPU 115 to the gaming device 102 and to the data storage device 124. The CPU 115 of the gaming server 106 can control the communication port to receive information from the data storage device 124 and transmit information to the gaming device 102 and vice versa.

The player database 144 may serve as one example of the communication capability of the communication network 104 to exchange data between the gaming server 106 and the gaming device 102. The player database 144 may be used to store data associated with specific players that are members of a gaming establishment's player loyalty program. The player database 144 stores player wagering data that can be converted into loyalty points and accumulated in the player's account.

Player loyalty programs reward players with complementary points as players wager on the gaming establishment's gaming devices. Loyalty points are generally redeemable for gifts and other discounts on goods and services, especially those offered by the gaming establishment.

The player database 144 may alternately or additionally store various other data associated with a player, such as the type of game or gaming device a player is currently playing or has played, the length of time a player has played a certain game or machine, information regarding wins and losses (e.g., a total amount won/lost for a given period of time, consecutive wins/losses, percentage of all plays that are wins/losses, etc.).

For example, the player database 144 may store data regarding a given player's standing in a game session or bonus game, so that the player can interrupt and then continue the game session or bonus game at one of a plurality of gaming devices that have common access to the player database 144.

The player database 144 may also be available to help assist in establishing multi-machine gaming for a player. Multi-machine gaming may have particular data capture needs. For example, special data capture requirements may be necessary to track player wagers over multiple numbers of gaming devices and to track the accumulation of player loyalty points on multiple gaming devices, etc.

In addition to establishing multi-machine gaming for a player with the player tracking database 144, a configuration database 148 may also be linked, in one embodiment, to the player tracking database 144. The configuration database may contain a number of rules that determine whether a player is eligible to control and play multiple gaming devices simultaneously. For example, the configuration database may contain a player status which indicates the player's eligibility to control multiple gaming devices. This status may be linked to accumulate player loyalty points, wagering activity, attaining specific winning game outcomes and any other measures related to the player's value to the gaming establishment.

In one embodiment, only selected gaming devices may have the ability to control another gaming device. The configuration database 148 may include technical information related to the gaming devices in the network to determine their availability. For example, gaming devices that are popular may not be allowed to be indirectly controlled. In another embodiment, gaming devices that are in use may also be excluded from indirect control. Data associated with these parameters may be stored in the configuration database along with rules that interpret this data to determine whether or not a player is eligible to control a specific gaming device. For example, the configuration database 148 may include data indicating whether a gaming device is in use and consequently unavailable for indirect control. The configuration database 148 may contain information regarding the identity of the player who is controlling a particular gaming device obtained from the player tracking database 144.

The player tracking database 144 may also include player preferences that allow customization of game play; including the selection of predetermined gaming devices. The configuration database 148 may link with the player tracking database 144 to obtain these preferences.

Although the player tracking database 144 may be used to provide support for various multi-machine game play embodiments, the primary focus of the player tracking system is to support tracking of player wagering to determine player loyalty points. As will be described in detail below, in one embodiment, the player tracking system operates through gaming device 102 to communicate a player's identifying information to the gaming server 106. The gaming server 106, in turn, collects statistical data regarding the player's game play (e.g., wagering activity). Player data may be stored in a relational database and retrieved or otherwise accessed by the CPU 115 after receiving a "key" data point from the player, such as a unique identifier read from the player's player-tracking card or cashless gaming voucher, PIN or code entered by a player using an input device of the gaming device 102, etc. It is contemplated that players may also identify themselves in a variety of other manners, such as by providing biometric identifiers, RFID identity devices, etc.

The player database 144 of the present embodiment may include multiple records having multiple fields of information. For example, FIG. 4 illustrates an embodiment of a player database 400 as an example of the player database 144 illustrated in FIG. 1 with exemplary entries. The player database 400 comprises multiple records, each record being associated with a particular player, as identified by player identification (ID) number 410. The fields within each record include the player identification (ID) number 410, Social Security number 412, name 414, address 416, telephone number 418, credit card number 420, credit balance 422, accumulated complimentary points 424, whether the player is a hotel guest 426, and player status rating 428.

The player database 400 may also have a pointer to a database containing information related to a player's casino account 430 from which a player may establish a balance on a gaming device. The player database 400 may also contain a pointer to a database containing information regarding a player's bank account 432. Alternatively, information to access both the casino account 430 and a bank account 432 may be available directly on the player-tracking database and associated with a player tracking identifier 410. Having information related to one field, such as player ID 410, allows the gaming server to retrieve all information stored in corresponding fields of that player record.

For example, in one embodiment, the player may be identified by a player tracking card, allowing the central server to retrieve information from the player database 400 regarding the player's casino account or other financial account. This information may include fields identifying a financial institution, account number, and appropriate wiring instructions to enable the gaming device to automatically transfer funds between the gaming device and a financial account.

Various systems for facilitating player tracking are contemplated. For example, a two-wire system such as one offered by International Gaming Systems (IGT) may be used. Similarly, a protocol such as the IGT SAS™ or SuperSAS™ protocol may be used. The SAS™ and SuperSAS™ protocols allow for communication between gaming devices and slot accounting systems and provide a secure method of communicating all necessary data supplied by the gaming device to the online monitoring system. One advantage of the SAS™ and SuperSAS™ protocols is the authentication function which allows operators and regulators to remotely interrogate gaming devices for important memory verification information, for both game programs, and peripheral devices. In another example, a one-wire system such as the OASIS™ System offered by Aristocrat Technologies™ or the SDS slot-floor monitoring system offered by Bally Gaming and Systems™ may be used. Each of the systems described above is an integrated information system that monitors gaming devices and customer gaming activity. Thus, for example, any one of these systems may be used to monitor a player's gaming activity in order to determine player outcomes, coin-in statistics, win/loss statistics and/or any other data deemed relevant.

Turning back to FIG. 1, the gaming network 100 may have a data storage device 124 for storing the player database 144 as well as storing other types of data in a number of databases. Examples of such databases include, but are not limited to, a games database 146 that stores game software for a plurality of games playable on and/or downloadable to one or more gaming devices 102. In one embodiment, the games database may contain a plurality of game programs, each game program having its own probability table and payout table. In some embodiments, the gaming server 106 may also contain a payout table and a probability table associated with the games available on the game's database. The ability to store games and associated probability and payout tables on the gaming server 106 allow this embodiment to perform most gaming operations on the gaming server 106 and download game outcomes to the gaming device 102 as explained in detail below.

It should be noted that embodiments using a server to determine game outcomes may be advantageous in environments or jurisdictions wherein the "central determination" of game outcomes is required by regulation or otherwise preferred. Thus, for example, outcomes may be determined centrally by a game server, and then propagated (e.g., electronically) such that indications of the outcomes may be viewed using one or more gaming devices (e.g., "Class II" gaming devices, "thin-client" gaming devices in a server-based "Class III" gaming architecture, Video Lottery Terminals, and so on).

In this embodiment, the gaming device 102 essentially comprises a thin client device controlled by the gaming server 106. The gaming server 106 may determine game outcomes for each of the gaming devices 102 and transmit those game outcomes (including associated graphics and audio data in some embodiments) to the gaming device 102. Multiple instances of the same game may be transmitted to different players on different gaming devices (i.e., the same game on the server 106 may be producing different game outcomes for different players playing at the same time at different gaming devices). In some embodiments, a plurality of game outcomes may be transmitted from the gaming server 106 to a gaming device 102 substantially simultaneously.

It is to be understood that because, in some embodiments, the gaming devices 102 are in communication with the gaming server 106, information stored in a gaming device 102 may be stored in the gaming server 106 and vice versa. Thus, for example, in an alternate embodiment, the gaming device 102, rather than the data storage device 124 may store one or more of these databases. In other embodiments, some or all of these databases may be partially or wholly stored in another network device 101, such as in a peripheral device server 112, a kiosk 110, the gaming server 106, or other gaming devices 102, etc.

It will be understood by one of ordinary skill in the art that (i) alternative database structures to those described herein may be readily employed; and (ii) other memory structures (e.g., a hierarchical electronic file system) besides databases may be readily employed. Any schematic illustrations and accompanying descriptions of any sample databases presented herein are illustrative arrangements for stored representations of information. Any number of other arrangements may be employed besides those suggested by the tables shown.

Similarly, any illustrated entries of the databases represent exemplary information only; those skilled in the art will understand that the number and content of the entries can be different from those illustrated herein. Further, despite any depiction of the databases as tables, other formats (including relational databases, object-based models and/or distributed databases) could be used to store and manipulate the data types described herein. Likewise, object methods or behaviors of a database can be used to implement the processes described herein. In addition, the databases may, in a known manner, be stored locally or remotely from a device, that accesses data in such a database.

With the communication network 104 and access to data from the data storage device 124, the gaming server 106 may be operable to configure (or reconfigure) a gaming device 102 remotely, update software stored on a gaming device 102 and/or to download software or software components to a gaming device 102. For example, a database (e.g., a payout or probability database) stored in the memory of gaming device 102 may be altered, modified, or updated remotely, hot fixes may be applied to software stored by the gaming device 102, and/or new software may be downloaded to the gaming device. Game software may be downloaded as needed to provide specific games desired by a player in real time. Similarly, the gaming device 102 may be programmed to retrieve any or all such updates from another device. Gaming server 106 may be programmed (e.g., with program 117) to perform any or all of the above functions based on, for example, an occurrence of an event (e.g., a scheduled event), satisfying a condition, receiving an indication from a qualified casino employee and/or other person (e.g., a regulator), receiving a request from a player.

Figure 2:
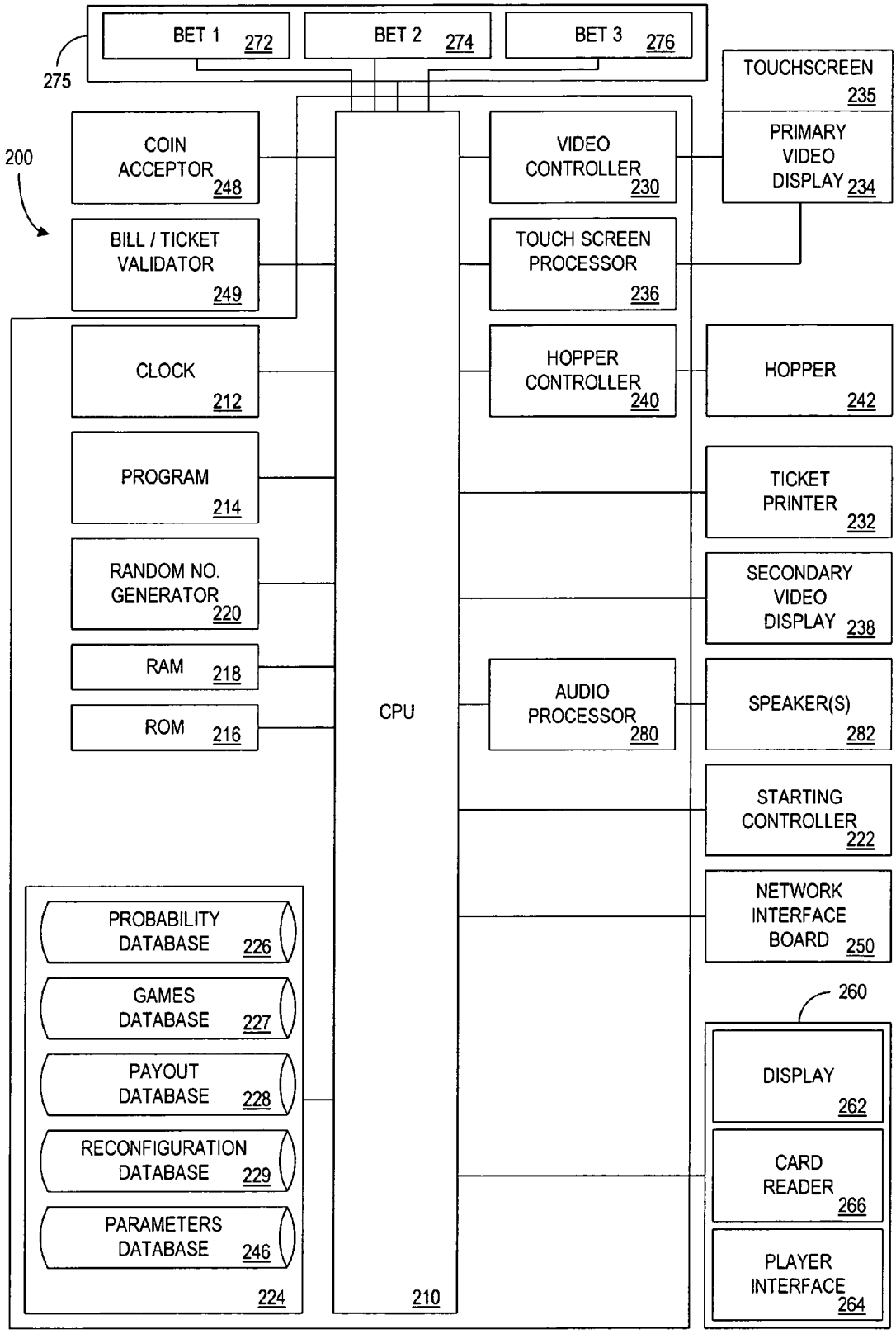
FIG. 2 is an exemplary block diagram of one embodiment of a gaming device of FIG. 1.

Referring now to FIG. 2, illustrated therein is one embodiment of a block diagram for a gaming device 200. The gaming device 200 may be an embodiment of a gaming device 102 shown in FIG. 1. The gaming device 200 has a CPU 210, which is communication with the communication network 104 of FIG. 1 through a network interface board 250. The network interface board 250 provides a communication path from the gaming device 200 to gaming server 106 through the gaming network 100. Thus, as discussed in detail below, information can be communicated between the gaming device 200 through its CPU 210 to the gaming server 106. In addition, the player-tracking device 260 and its associated player interface 264 (e.g., a keypad) which is also in communication with the gaming device's CPU 210, may provide a communications link between the player and the gaming device 200 or even the gaming server 106 through the gaming device's 200 CPU 210.

With respect to some gaming operations, the gaming device 200 may operate in a conventional manner. The player starts the gaming device 200, for example, by inserting a coin into the coin acceptor 248 or a bill into the bill validator 249. A starting controller 222 may initiate operation of the gaming device 102 to produce a random game outcome.

The gaming device 200 contains a Central Processing Unit (CPU) 210 that executes instructions of a program 214 stored in Read Only Memory (ROM) 216 for playing the gaming device 200. The CPU 210 performs instructions of the program 214 and thereby operates to perform in accordance with the methods described in detail herein. The program 214 may be stored in a compressed, uncompiled, and/or encrypted format. The program 214 may also include program elements that may be necessary, such as an operating system, a database management system and "device drivers" for allowing the processor to interface with computer peripheral devices.

According to one embodiment, the instructions of the program may be read into a main memory (e.g., Random Access Memory (RAM) 218) from another computer-readable medium such as from a ROM 216. The system bus carries the data to main memory, from which the CPU 210 retrieves and executes the instructions. The instructions received by main memory may optionally be stored in memory either before or after execution by the CPU 210. RAM 218 may also temporarily store information communicated to it by the CPU 210 during game play.

Execution of sequences of the instructions in program 214 causes CPU 210 to perform the process steps described herein. In alternate embodiments, hard-wired circuitry may be used in place of, or in combination with, software instructions for implementation of the reconfiguration process. Thus, the various embodiments are not limited to any specific combination of hardware and software.

The CPU 210 and the memory 216 and 218 may each be, for example: (i) located entirely within a single computer or other device; or (ii) connected to each other by a remote communication medium, such as a serial port cable, telephone line, or radio frequency transceiver. In one embodiment, the gaming device 200 may comprise one or more devices that are connected to a remote server for maintaining databases.

Under control of a program stored, for example ROM 216, the CPU 210 initiates the RNG 220 to generate a random number. The random number generator 220, in accordance with at least one embodiment, may generate data representing random or pseudo-random values (referred to as "random numbers" herein).

The random number generator 220 may generate a random number, for example, every predetermined unit of time (e.g., every thousandth of a second) or in response to an initiation of a game on the gaming device 102. In the former embodiment, the generated random numbers may be used as they are generated (e.g., the random number generated at substantially the time of game initiation is used for that game) and/or stored for future use. A random number generated by the random number generator 220 may be used by the CPU 210 to determine, for example, at least one of an outcome and payout.

A random number generator 220, as used herein, may be embodied as a secondary processor, separate from, but working in cooperation with the CPU 210. Alternatively, the random number generator 220 may be embodied as an algorithm, program component, or software program stored in the memory of the gaming device 200 and used to generate a random number. Note that, although the generation or obtainment of a random number is described herein as involving a random number generator 220 of a gaming device 200, other methods of determining a random number may be employed.

For example, a gaming establishment may obtain sets of random numbers that have been generated by another entity. There are services that provide random numbers that have been generated by timing successive pairs of radioactive decays detected by a Geiger-Muller tube interfaced to a computer.

As would be understood by one of ordinary skill in the art, a random number generator 220 may be stored in a device other than a gaming device 200. For example, in some embodiments, a gaming device 200 may receive random numbers and/or any other data related to the random or pseudo-random determination of an outcome from a separate device, such as the gaming server 106 shown in FIG. 1. In fact, the gaming server 106 (and/or the data storage device 124) may contain not only the random number generator 220, but also the probability and pay table databases necessary to determine a winning game outcome, and the payout award for such a winning game outcome. This arrangement might be implemented for use in a thin-client type gaming device (i.e., a "dumb" terminal or "smart-enough" terminal).

The CPU 210 as shown in FIG. 2 looks up the generated random number in a stored probability database 226, which contains a list that matches random numbers to corresponding game outcomes to determine a game outcome based on the generated random number.

A probability database 226 may be stored in the gaming device's 200 ROM 216 or in any other data storage device 224. The data stored therein may include a number of records or entries, each defining a random number. Those skilled in the art will understand that the probability database may include any number of entries. The tabular representation may also define fields for each of the entries or records. The fields may specify: (i) a random number (or range of random numbers) that may be generated by the random number generator 220; and (ii) an outcome that indicates the one or more indicia comprising the outcome that corresponds to the random number of a particular record. These indicia comprise the game outcome that is then displayed to the player in the primary video display 234.

The indicia representing the game outcome may comprise reel symbols commonly displayed on the reels of slot type gaming devices. The indicia may also be cards from a card deck displayed on the video display on a video poker gaming device. For example, the book "Winning at Slot Machines" by Jim Regan (Carol Publishing Group Edition, 1997) illustrates examples of payout and probability tables and how they may be derived. The payout and probability methods taught in this book are hereby incorporated by reference in their entirety. Of course, the indicia may be any indicia appropriate for the game or type of game being played.

In an alternate embodiment, rather than using a video display to present indicia, mechanical reels with indicia on the circumference of the reel may be spun and randomly stopped to present a game outcome in a window of the gaming device. The CPU 210 determines the game outcome based on the random number selected by the random number generator. The CPU 210 is in communication with a reel controller that controls the motion of the reels. The reel controller causes the reels to spin and stop at a combination of reel positions corresponding to the game outcome.

Based on the identified game outcome, the CPU 210 locates the appropriate payout in a payout database 228. The payout database 228 may be stored in the gaming device's 200 RAM 218 (alternatively, the payout database may also be stored in any other data storage device 224).

A payout database 228 may store a number of entries associated with each possible game outcome represented by the indicia determined by the probability table. The tabular representation defines fields for each of the entries or records. The fields specify: (i) an outcome, which indicates the one or more indicia comprising a given outcome, and (ii) a payout that corresponds to each respective outcome.

The outcomes may be those obtained from winning game outcomes typically obtainable on a video poker gaming device (e.g., royal flush, straight flush, straight, four-of-a-kind, full house, two pair, three-of-a-kind, and pair). With the payout database 228, the payout of any winning game outcome can be determined. Alternatively, game outcomes may be represented by reel symbols; with winning game outcomes determined by the order and type of symbol as presented in the display.

The described entries of the probability database 226 and the payout database 228 represent exemplary information only; those skilled in the art will understand that the number and content of the entries can be different from those illustrated herein. Further, despite any description of the databases as tables, an object-based model could be used to store and manipulate the data types and likewise, object methods or behaviors can be used to implement the processes described herein.

In addition to determining a game outcome, the CPU 210 controls a variety of peripheral devices associated with the gaming device that may be used to assist the player in making wagers and receiving payouts. The CPU 210 is operable to communicate (e.g., via a protocol such as GDS) with these various peripheral devices associated with the gaming device 102.

The following is a description of some of the peripheral devices that are available in gaming devices 200. These peripheral devices may be classified as either input devices (e.g., player input to gaming device), output devices (e.g., gaming device output to player), or interface devices that have both input and output type characteristics. It should be understood that not all of the peripheral devices are necessary and further, that the peripheral devices may be used in any combination, including using a plurality of the same peripheral device in a single gaming device 200.

Some examples of input devices include wager acceptors, for initiating game play on the gaming device 200, such as the coin acceptor 248. A coin acceptor 248 is coupled to the CPU 210. Each coin received by the coin acceptor 248 is registered by the CPU 210. A hopper controller 240 is connected to a hopper 242 for dispensing the collected coins when a winning game outcome occurs. In addition, when the player requests to cash out by pushing a cash out pushbutton (not shown) on the gaming device 200, the CPU 210 checks the RAM 218 to see if the player has any credit and, if so, signals the hopper controller 240 to release an appropriate number of coins into a payout tray (not shown).

Another type of wager acceptor is the bill/ticket validator 249. The bill/ticket validator accepts either paper currency or ticket vouchers. This voucher operates similarly to cash and is generally accepted by most gaming devices 200 in the gaming establishment with a bill/ticket validator 249.

The voucher may be printed by a ticket printer 232 located in the gaming device 200. For example, when a player cashes out, instead of accepting payment in coin, the player may request a ticket voucher. The credit balance (i.e., balance) on the credit meter of the gaming device 200 before the cash out request is indicated on the ticket voucher. The ticket voucher generally contains a bar code and other legible indicia that indicate the gaming establishment and the monetary value of the voucher.

The bar code on the voucher is machine-readable by the bill/ticket validator 249. The player simply inserts the voucher (as the player would for paper currency) into the bill/ticket validator 249 and the value of the voucher is determined. The gaming device 200 communicates with a gaming server 106 (shown in FIG. 1) that manages the accounting associated with such ticket-in/ticket-out transactions (e.g., to track the issuance, redemption and expiration of such vouchers). An example of such ticket-in/ticket-out technology, the EZ PAY system, is manufactured by International Gaming Technology, headquartered in Reno, Nev. The monetary value of the voucher is displayed on the gaming device's credit meter and is available for wagering. Other forms of payment may be available including the use of credit cards, debit cards, smart cards, credits/currency from electronic accounts (e.g., a player "downloads" credits from a central server), etc. to make wagers.

Also in communication with the CPU 210 is a player-tracking device 260. The CPU 210 is in turn in communication with a server 106 (shown in FIG. 1) that contains the player database 144. The player-tracking device 260 has a card reader 266 as shown in FIG. 2, which accepts a player-tracking card for reading player-identifying information stored on a player-tracking card (e.g., a player identification (ID) number). Although not so limited, the player-tracking card of the present embodiment stores the player ID on a magnetic strip located thereon. Alternatively, any player identifying indicia may be used, including biometric indicia.

The player-tracking device 260 has a player-tracking display 262 and a player interface 264 that allows the gaming device 200 and/or server 106 to communicate with the player. The player interface 264 may include a keypad and/or a touch-screen display.

Other examples of input devices that facilitate game play include the pushbutton panel 275. The pushbutton panel 275 allows the player to make various choices including wager amounts and game selections. The gaming device 200 also includes a plurality of bet pushbuttons 272, 274, 276. The bet pushbuttons include "Bet 1 coin" 272, "Bet 2 coins" 274, and "Bet 3 coins" 276. The bet pushbuttons 272, 274, 276 are coupled to the CPU 210. Therefore, a pushbutton transmits a signal to the CPU 210 indicating how much a player is wagering on a given play. Other examples of input devices include keypads, microphones, and a video camera may be in communication with the CPU 210 or with the player-tracking device 260.

The CPU 210 may also be operable to communicate with various output devices. In some embodiments, an output device comprises a game display. The primary video display 234 may comprise, for example, one or more display screens or areas for outputting information related to game play on the gaming device 200, such as a cathode ray tube (CRT) monitor, liquid crystal display (LCD) screen, and/or light emitting diode (LED) screen.

In one or more embodiments, a gaming device 200 may comprise more than one game display. For example, a gaming device 200 may comprise an LCD display for displaying images of reels (or card hands in the case of a video poker gaming device) (e.g., a primary video display 234) and a display area that displays rotating mechanical reels.

Alternately, a gaming device 200 may have a video display 234 for the outcome of a primary game played on the gaming device and a secondary video display 238 may display rules for playing a game of the gaming device, the outcome of secondary games played in conjunction with the primary game, game outcomes achieved and/or additionally output by other gaming devices during multi-machine play, and so on.

The CPU 210 may also be in communication with one or more other output devices. Such devices may comprise, for example, a primary video display 234 through a video controller 230, an audio speaker 282 through an audio processor 280; headphones; an infrared transmitter; a radio transmitter; an electric motor, etc. The CPU 210 may also be in communication with a wireless portable gaming device 120 (shown in FIG. 1) that may receive in some embodiments game outcomes from gaming device 200.

Another type of output device is required to pay off winning game outcomes. For example, the coin hopper 242 may pay out coins from the gaming device or a ticket voucher may be provided for a winning game outcome. In yet another example, the gaming device 200 may credit a monetary amount to an account associated with a player as a pay out provided to a player. The account may be, for example, a credit card account, a debit account, a charge account, a checking account, or a casino account (e.g., an account from which the player may access cashable and/or non-cashable funds using a player tracking card or smart card).

A gaming device 200 may also include a touch screen 235 and a touch screen processor 236 associated with a primary video display 234. The touch screen 235 and touch screen processor 236 may be operable to communicate with a video controller 230 of the primary video display 234 and a CPU 210. Thus, a player may be enabled to indicate decisions or choices by touching the touch screen 235 in the appropriate places.

The primary video display 234 may operate in conjunction with the video controller 230 in the CPU 210 to produce multiple separate images on the gaming device 200. Each of these separate images may originate from a separate and independent video signal. This allows a single primary video display 234 to display a plurality of separately and independently acquired images. The video controller may also be programmed to provide synchronized images of game outcomes on not only the primary and secondary video displays of one gaming device, but also on a plurality of gaming devices. Accordingly, a single image may be displayed using the video displays of a plurality of gaming devices.

Figure 3:
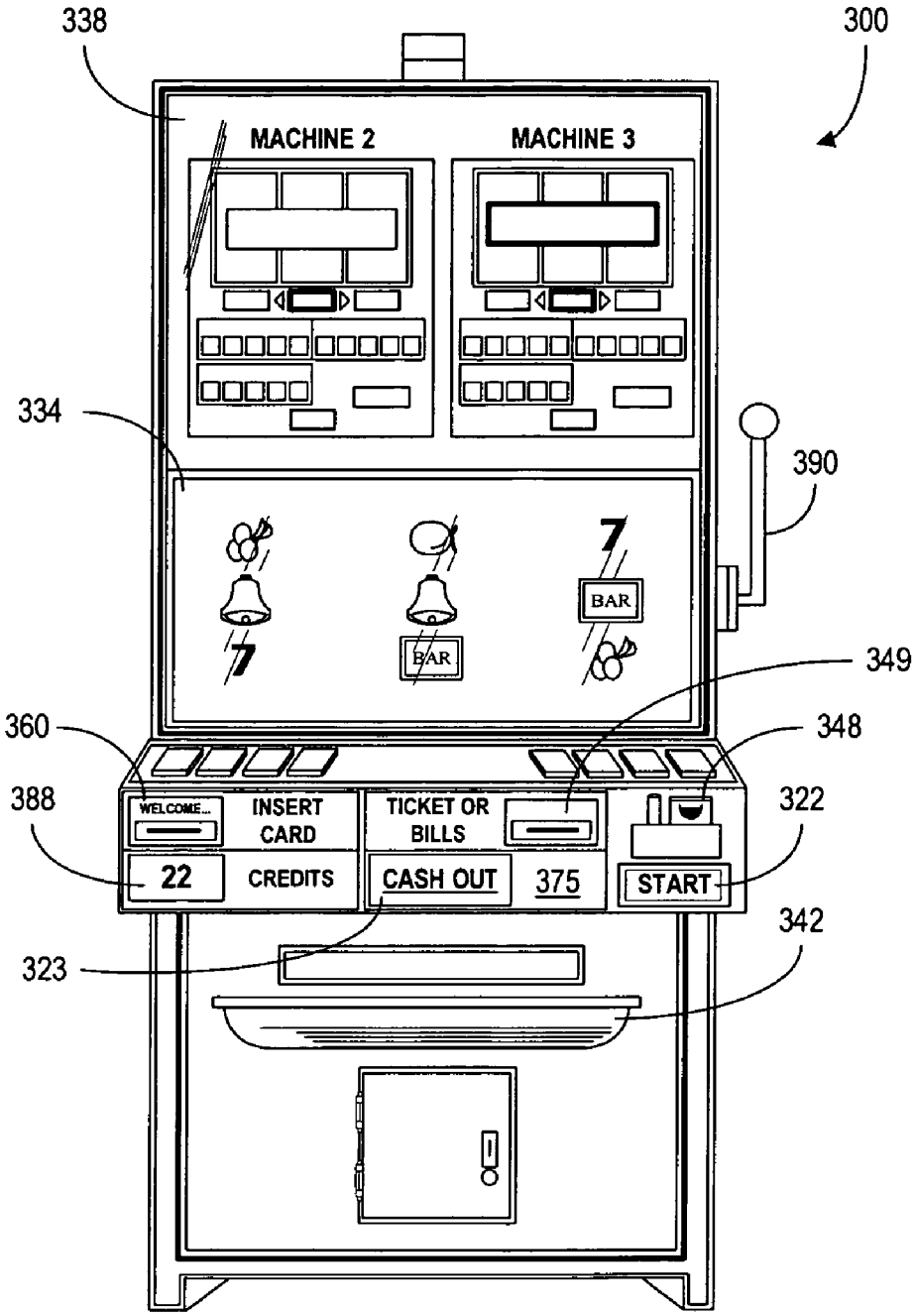
FIG. 3 is an exemplary orthographic view of one embodiment of a gaming device of FIG. 1.

Turning to FIG. 3, an orthographic view of a gaming device 300 is presented, in accordance with one example embodiment. The gaming device 300 may comprise, in one embodiment, for example, the gaming device 200 of FIG. 2 and/or a gaming device 102 of FIG. 1. A number of peripheral components are visible on the gaming device 300 and are explained below from the view of a wagering player.

A gaming device 300 may comprise a display area in which a game outcome is displayed to the player. The display area may, for example, be a primary video display 334 that displays graphical representations of reel symbols or other indicia used to indicate a game outcome. The display area may, in another example, be glass behind which are located mechanical reels. In one embodiment, the display area may be used to display a user interface for controlling other gaming devices as shown in FIG. 3 in one example embodiment. A secondary video display 338 may also be used to display game outcomes or other game information (e.g., additional game outcomes). To increase the display capability of the gaming device 300 even further, video display 334 and/or 338 may be configured to provide a plurality of separately and independently obtained video images.

A player desiring to wager on gaming device 300 may first present a player-tracking card to the player-tracking device 360 associated with gaming device 300 to accrue player loyalty points. Typically, a player is provided with a player-tracking card, which contains a unique player identifier that is read by the gaming device. The player's wagering activity is reported by the gaming device to a server where it is recorded in a database. The server maintains a running total of the player's loyalty points as they are accrued through the player's wagering activity.

The player then establishes a credit balance on the credit meter 388. The credit meter balance reflects the electronic credits currently available to a player to make a wager. The gaming device 300 typically has two wager acceptors—a coin acceptor 348 and a bill/ticket acceptor 349 with which to establish a credit balance on a credit meter.

Electronic credits are typically either a basic monetary unit or a fraction of a basic monetary unit. For example, inserting a one-dollar bill into a 25-cent gaming device results in a four-credit balance on the credit meter 388. Alternatively, inserting a one-dollar bill into a $1 gaming device results in a one-credit balance on the credit meter. Some gaming devices may also be multi-denominational, i.e., selectively converting player funds into credits at different rates. For example, a multi-denominational gaming device could exchange a dollar of player funds into one credit as in a one-dollar denomination gaming device, or four credits as with a 25-cent gaming device per the player's direction.

The electronic credits may be "cashed out" as coins, bills, tokens, a ticket voucher, and/or transferred to a player's account (e.g., a casino account maintained by a wagering establishment or a bank account).

In another embodiment, rather than providing physical currency such as coins, bills, or ticket vouchers, electronic means may be used to establish a credit balance on the credit meter 388. For example, a player tracking card may identify a player and an account the player has with the casino. This casino account may be funded by the player, and as needed, downloaded to the gaming device to establish a credit balance on the credit meter 388.

Alternatively, a smartcard with a monetary balance encoded on an electronic chip (memory) may be read by the gaming device causing the monetary balance on the smart card to be transferred to the gaming device. The smart card may be purchased from the casino in various denominations and used as though it were cash in the gaming establishment.

It is also possible to download monetary value from a player's account at a financial institution. The withdrawal is made from the player's account at the financial institution and transferred to a server at the gaming establishment. The balance is subsequently downloaded to the gaming device, which displays the equivalent electronic credits on the credit meter 388. In one embodiment, a player tracking card may be used to access this feature. The player tracking card identifies the player with the player's identifier encoded on the player tracking card. The player identifier in turn accesses a database to determine transactional information needed to access the players account at the financial institution. This information may include the players account number at the financial institution, bank routing number, and other data to establish a credit balance on the gaming device.

Once a wager has been placed, the player can start the gaming device 300 with the pull handle 390, or the start pushbutton 322 on the pushbutton panel 375. The game outcome is shown on the primary video display 334.

Traditionally, a player was able to receive a cash out from the gaming device in the form of coins dispensed from a hopper into a coin tray 342. The player pushed a cash out pushbutton 323, the coins were dispensed into the coin tray, and the credit balance meter 383 was reduced to zero. In some embodiments, gaming devices are able to offer other alternative monetary forms in which to receive a cash out. For example, a player may receive a cash out in the form of a ticket voucher from the ticket printer. Alternatively, the player may request to return remaining credits on the credit meter back to the player's a casino account.

With a basic understanding of the gaming device and the gaming network in which it may operate in one embodiment, the methods for enabling a player to establish control over multiple gaming devices to receive a plurality of game outcomes from different gaming devices.

Multi-Machine Game Play

Configuring for Multi-Machine Game Play

Because players may want to play multiple gaming devices, a method and apparatus as described below that can be implemented to enable a player to control, operate, and/or play a plurality of gaming devices simultaneously (e.g., at the same time or at approximate same time). For example, in one embodiment, the gaming devices may produce game outcomes almost simultaneously. In another embodiment, the gaming devices may produce game outcomes sequentially.

Figure 5:
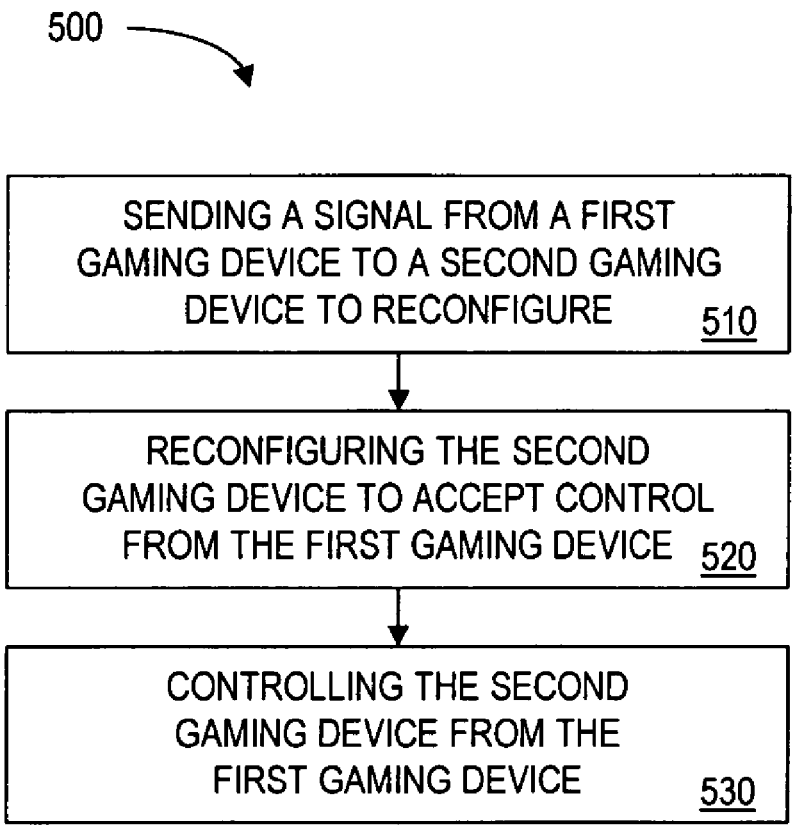
FIG. 5 is an exemplary flowchart illustrating one embodiment for a process of establishing control of a second gaming device from a first gaming device.

Turning to FIG. 5, an exemplary embodiment of a flow process is illustrated for allowing player control of multiple gaming devices. The first gaming device (i.e., the controlling gaming device) sends a signal to a second gaming device (i.e., the controlled gaming device) (e.g., through a computer network) to initiate the reconfiguration of the second gaming device in step 510.

The signal may be sent from the first gaming device to the second gaming device through a number of different routes dependent upon the embodiment. For example, the signal from the first gaming device may be sent through the computer network to a server which routes the signal to the second gaming device. In another embodiment, the signal from the first gaming device may be sent directly to the second gaming device in a peer-to-peer network. In a third embodiment, a local bank controller may be used to route a signal sent from the first gaming device in the bank to a second gaming device in the bank.

Having received the signal, the second gaming device reconfigures to allow control by the first gaming device in step 520. The first gaming device takes control of the second gaming device in step 530. With this control, the first gaming device controls both the first and the second gaming device to produce (e.g., multiple) game outcomes.

The first gaming device is under the control of a player who controls game play on the first gaming device and also on the second gaming device. The player controls game play on the second gaming device through a user interface on the first gaming device. The first gaming device may be controlled, in one embodiment, through standard player input peripheral devices such as with pushbuttons through the pushbutton panel, the touch screen video display, etc. The first gaming device may also be controlled by the player through the user interface. The user interface may be, in one embodiment, a graphical user interface (e.g., a touch screen video display) and/or pushbuttons on a pushbutton panel.

In another embodiment, the first gaming device may send a signal to a gaming server and the gaming server may control the second gaming device in response to the signal. In one embodiment, the gaming server may be operable to configure the second gaming device to control that gaming device, or enable it to be controlled.

Game outcomes for each of the controlling and the controlled gaming devices may be determined, in various embodiments, by each gaming device respectively, determined by one of the gaming devices, or may be determined by a server in communication with each of the gaming devices. In one embodiment, the player may select the gaming device or the server that provides the game outcomes. In another embodiment, the player may determine which game outcomes come from a gaming device or server.

In another embodiment, the player might not specify which device is to generate the multiple simultaneous game outcomes. In this embodiment, a protocol may exist to determine which of the gaming devices and servers provide the game outcomes. For example, in one embodiment, the number of simultaneous game outcomes may determine the protocol for determining which of the gaming devices and/or servers is to provide the game outcomes. For example, if more than five game outcomes are requested, the gaming device and a server each determine game outcomes. In another embodiment, only the server will determine the game outcomes.

In one embodiment, the player determines the specific gaming devices the player wants to control. For example, in one embodiment, a player may elect to receive game outcomes from immediately adjacent gaming devices, though other methods of identifying gaming devices are contemplated (e.g., a player enters an identification code associated with a gaming device or selects a gaming device from a menu of available gaming devices). The player may select and control gaming devices (e.g., adjacent gaming devices) from a graphical user interface located on the player's gaming device (i.e., controlling gaming device).

In certain embodiments, a plurality of player tracking cards, all assigned to the same player, may be required to control multiple gaming devices. For example, in this embodiment, a player may be required to insert a player tracking card into each of the gaming devices that the player wants to control. Once the player tracking cards have been registered by the gaming device, the player may then subsequently control that gaming device from the controlling gaming device. The insertion of the player tracking card in each of the controlled gaming devices (as well is the controlling gaming device) insures the control and tracking of the gaming process.

In another embodiment, a player may indicate a characteristic of a second gaming device and the second gaming device may be selected on behalf of the player such that the characteristic indicated by the player is satisfied. For example, the player may indicate a type of game that the player would like to play. The gaming server or first gaming device, may then select an available second gaming device that is operable to support the game. For example, a player may specify a certain game and request to control all available gaming devices having that game.

Figure 6:
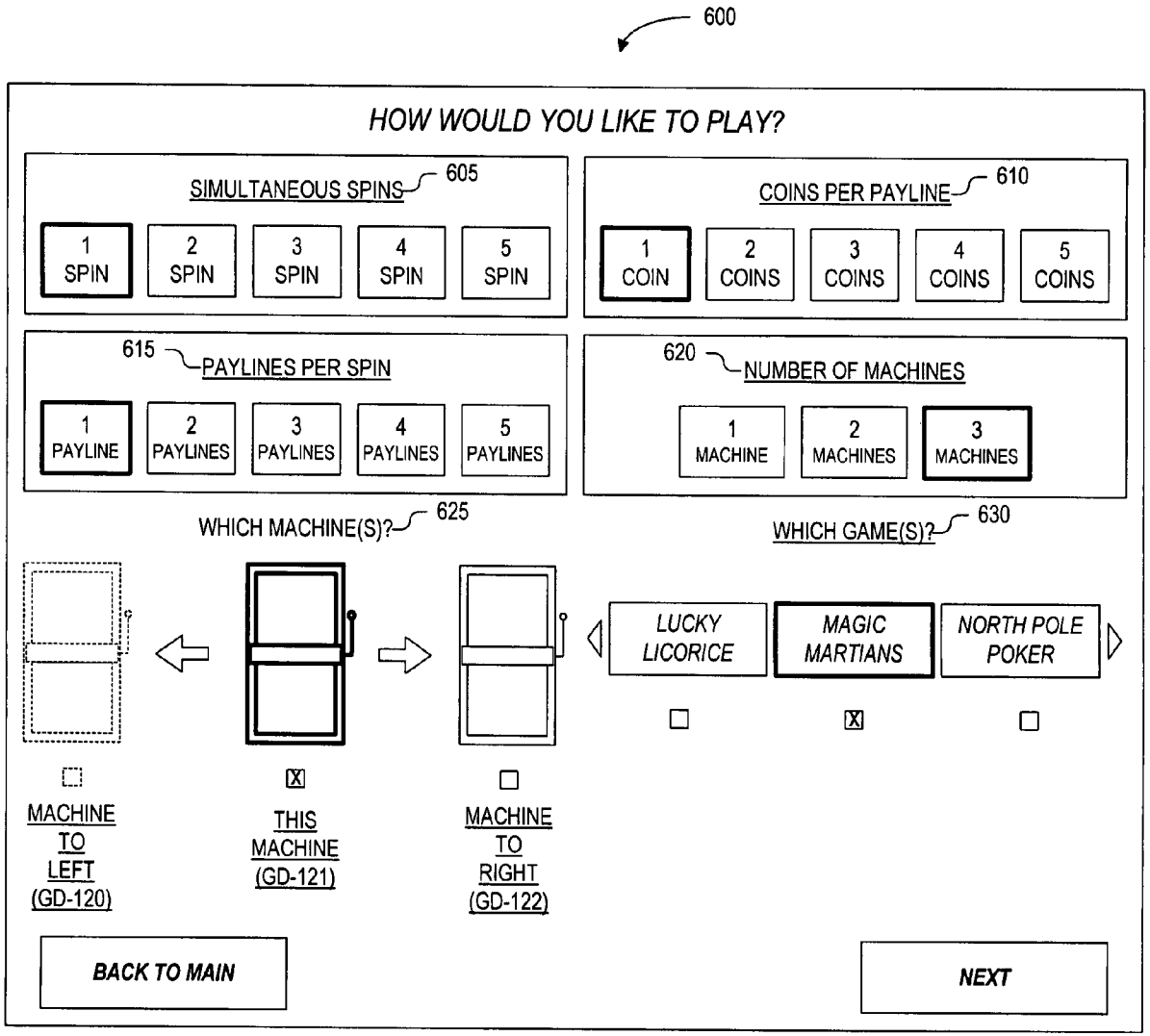
FIG. 6 is an exemplary user interface for specifying game play parameters on a plurality of gaming devices, in accordance with some embodiments.

The user interface, in one embodiment, may be displayed on the video display of the controlling gaming device. One embodiment of the user interface is shown in FIG. 6. In this embodiment, a player may select either or both of the adjacent gaming devices to the player's gaming device to present and/or determine game outcomes by selecting the number of gaming devices desired 620 and their location with the gaming device indicator 625. Of course, in some embodiments a second gaming device need not be adjacent to the first gaming device in order to be eligible for selection. For example, in such an embodiment, the player may, for example, select non-adjacent gaming devices based on a gaming device identification number, via a touch screen map of the gaming establishment floor designating specific gaming devices, etc.

The user interface is selectively available, in one embodiment, only when a player desires to control another gaming device. The user interface, in this embodiment, may become visible on the primary or secondary video display at the request of the player. For example, a help screen or a dedicated pushbutton on the pushbutton panel may be used to activate the user interface.

In another embodiment, the user interface may be constantly available to the player. For example, and one embodiment the user interface may be displayed on a separate secondary video display. In still another embodiment, the user interface may be presented on the primary video display with the game outcomes and located in a non-obtrusive location. For example, in one embodiment, the user interface may take on a "dashboard" type configuration that extends across the top of the primary video display, and in some embodiments, along the bottom and/or sides of the primary video display. With the appropriately sized dashboard, the game outcomes may be provided on the primary video display while still providing user interface control on the same video display.

Once a controlling gaming device has been selected (by or on behalf of a player), in some embodiments, an indication may appear on that gaming device signaling control of another gaming device. Controlling gaming devices may be indicated with appropriate signage and/or other indicators. The controlled gaming devices, once selected, may also provide, in some embodiments, an indication of its controlled status. Such an indication may appear either on the controlled gaming device's video display or other available signage or electronic indicators associated with the controlled gaming device. Indicating controlled gaming devices is useful as it provides other players notice that the controlled gaming device may be locked out and unavailable for the use of other players.

Transient indicators may appear as certain game outcomes or other game events occur or become available. These indicators assist the player in identifying a particular video display on one the grouped gaming devices, and even a particular location on that video display, of significant game play information which might not otherwise be perceived.

Once a player of a controlling gaming device selects controlled gaming devices, the controlled gaming devices may be locked out, in one embodiment, to other players. The CPU of the controlled gaming devices, in one embodiment, is signaled to disable the coin acceptor, push button panel, touch screen, bill validator, pull arm (if any), player tracking card reader, and any other peripheral component that accepts player input. In another embodiment, the controlled gaming device operates in an alternative operating mode determined by the controlled gaming devices software allowing the controlled gaming device to disable predetermined peripheral devices and to allow control from the controlling gaming device. Accordingly, in one embodiment, a controlled gaming device may only be played indirectly by the controlling gaming device.

In some embodiments, a controlled device may be operable by a second player; either piggybacking on the game outcomes received by the first player (i.e., receiving the same game outcomes as the first player) or, in another embodiment, receiving separate game outcomes.

In still another embodiment, two players may alternately control a third gaming device. For example, in this embodiment, two players each control their own gaming device and alternately control a third gaming device. For example, three gaming devices may be grouped together, with a player directly controlling a first gaming device, another player controlling a second gaming device, and a third gaming device in the middle (between the first and second gaming devices) for which the two players competitively vie for control. Control of the third gaming device may be a function of attaining some game play parameter (e.g., the success of the players wagering activity, attainment of some level game level, a specific winning game outcome, etc.). Once a game play parameter is satisfied, the player gains control of the third gaming device. With continued game play, however, in one embodiment, the second player may obtain a required game play parameter that either qualifies the player to control the third gaming device or removes the first player from control of the third gaming device. A variety of different parameters may be established, in one embodiment, to trigger the transfer of control, or remove control, from a player over a third gaming device. In one embodiment, certain incentives may be applied to the game play mechanic that makes control of the third gaming device attractive. Enhanced payouts, bonus game play, increase payback percentages, free game play, and any other similar mechanisms may be used in various embodiments to reward a player's ability to control the third gaming device.

In certain embodiments, the controlled gaming devices contain operational components (i.e., peripheral devices or components that are not disabled by virtue of the controlled status of the gaming device) that interface with the controlling gaming device to determine and provide game outcomes. For example, in one embodiment, the video displays of the controlled gaming devices are still operational to present game outcomes. In addition, the CPU of the controlled gaming device is in communication with the computer network to receive commands from the controlling gaming device (either directly via peer-to-peer communications or indirectly through a gaming server or gaming controller).

Commands received from the controlling gaming device are processed by the CPU of the controlled gaming device, in one embodiment. In one embodiment, the controlled gaming device may have a slave operating mode (i.e., a program) to accommodate and facilitate indirect control. For example, on a signal from a controlling gaming device, the CPU reconfigures the gaming device to operate in slave mode. This reconfiguration may include locking out or disabling certain player input devices as described above. Furthermore, it includes, in some embodiments, changing the operational mode of the indirectly controlled gaming device to accept commands from the controlling gaming device. These commands may include generating and/or displaying a game outcome on request. Other controlling gaming device commands may include, for example, establishing both audio and video synchronization between grouped gaming devices (i.e., the controlling and the controlled gaming devices). Interfacing the audio and video processors of the grouped gaming devices allows both audio and video synchronization of the game outcomes for presentation to the player on all or some of the grouped displays. For example, in one embodiment, all the video displays may be grouped to create one large video display of a single image (e.g., an image is "spread" across multiple display screens).

The controlling gaming device, in one embodiment, may request a game outcome from the controlled gaming device. Accordingly, the CPU of the controlled gaming device produces a random number to determine a game outcome. In an alternate embodiment, the controlling gaming device may generate a random number for the controlled gaming device to use to determine a game outcome. In still another embodiment, the controlling gaming device may determine the random number and the game outcome for each of the indirectly controlled gaming devices.

In those embodiments, in which the controlled gaming device determines the game outcome, the controlled gaming device communicates the game outcome to the controlling gaming device (and, in some embodiments, the award amount for a winning game outcome). The controlling gaming device processes the winning game outcome from the controlled gaming device, including crediting a credit meter of the controlling gaming device to indicate a winning game outcome from the controlled gaming device.

The above methods for providing random numbers for generating game outcomes depends on the gaming device itself for generating random numbers. In another embodiment, a gaming server may determine random numbers for the gaming devices. These random numbers may be communicated to each of the gaming devices to allow a game outcome to be determined.

Turning back to FIG. 6, in one embodiment, in addition to selecting the additional gaming devices, the user interface menu may also allow the player to make standard selections (individually for each gaming device) associated with slot type gaming devices (or video poker type gaming machines) such as number of pay lines 615 and wager amount per payline 610. In some embodiments, the gaming devices may offer a variety of wagering games. In these embodiments, the user interface menu shown in FIG. 6 may also allow the player to select available games 630 from the plurality of the games offered by the gaming device.

The player may also select the number of simultaneous spins 605 (i.e., game outcomes) to receive simultaneously. For example, as shown in FIG. 6, the player has selected to receive one simultaneous spin (i.e., a game outcome) from each of the grouped gaming devices. In this embodiment, each of the gaming devices would sequentially cycle, determine a game outcome, and present that game outcome to the player before determining the next game outcome.

In another example, the player may select to receive three simultaneous spins. Each of the gaming devices determines, in this embodiment, three game outcomes. Again, the player may select how these game outcomes are presented. In one embodiment, each gaming device may display three game outcomes. In still another embodiment, all nine game outcomes may be stretched over the video displays of all three gaming devices.

Game outcomes may be presented randomly across a plurality of video displays or on a single video display. Game outcomes may be segregated according to winning game outcomes and losing game outcomes-winning game outcomes presented at one video display and losing game outcomes on another, different video display. The player may also allocate the number of game outcomes to be displayed on each video display. For example, if three gaming devices are played, each with three simultaneous spins, seven game outcomes may be displayed on one video display and one game outcome may be displayed on each of the two remaining gaming devices.

In another embodiment, rather than receiving the game outcomes simultaneously, the game outcomes are received sequentially. For example, if the player has selected to receive one spin (i.e., one game outcome for each gaming device), each game outcome may be presented sequentially with a time lag between each game outcome received from each gaming device. This time lag allows the player to recognize and understand the game outcome.

In another embodiment, when each of the game outcomes is presented sequentially, the timing between the presentation of each game outcome is determined by the player with an actuation device (e.g., a start game button). The actuating device to receive the game outcomes may be a single actuation device or in another embodiment, a separate actuation device may be dedicated to each of the gaming devices. For example, the controlling gaming device may be actuated by its own dedicated pushbutton, while the user interface displayed on the controlling gaming device may have separate actuation devices for each of the controlled gaming devices. Accordingly, the player can determine the pace of game play. The user interface of the controlling gaming device may also be used to actuate the controlled gaming devices to receive game outcomes.

Furthermore, in one embodiment, the order of the presentation of each of the three game outcomes may be determined by the controlling gaming device. For example, the game outcomes may be progressively ordered from losing to winning game outcomes. Alternatively, the game outcomes may be ordered to provide a less volatile gaming experience. Otherwise, the gaming outcomes may be presented in any order desired, including randomly or in a predetermined order with respect to the relative position of each of the gaming devices.

In addition to selecting the number of simultaneous spins, the player may also determine the number of activated pay lines per spin 615 (in the case of a slot type gaming device) and also the coins per pay lines 610, as shown in FIG. 6. Consequently, a player is able to select all the game parameters required to initiate game play from a single graphical user interface 600.

Selection of Game Outcome Presentation

Figure 7:
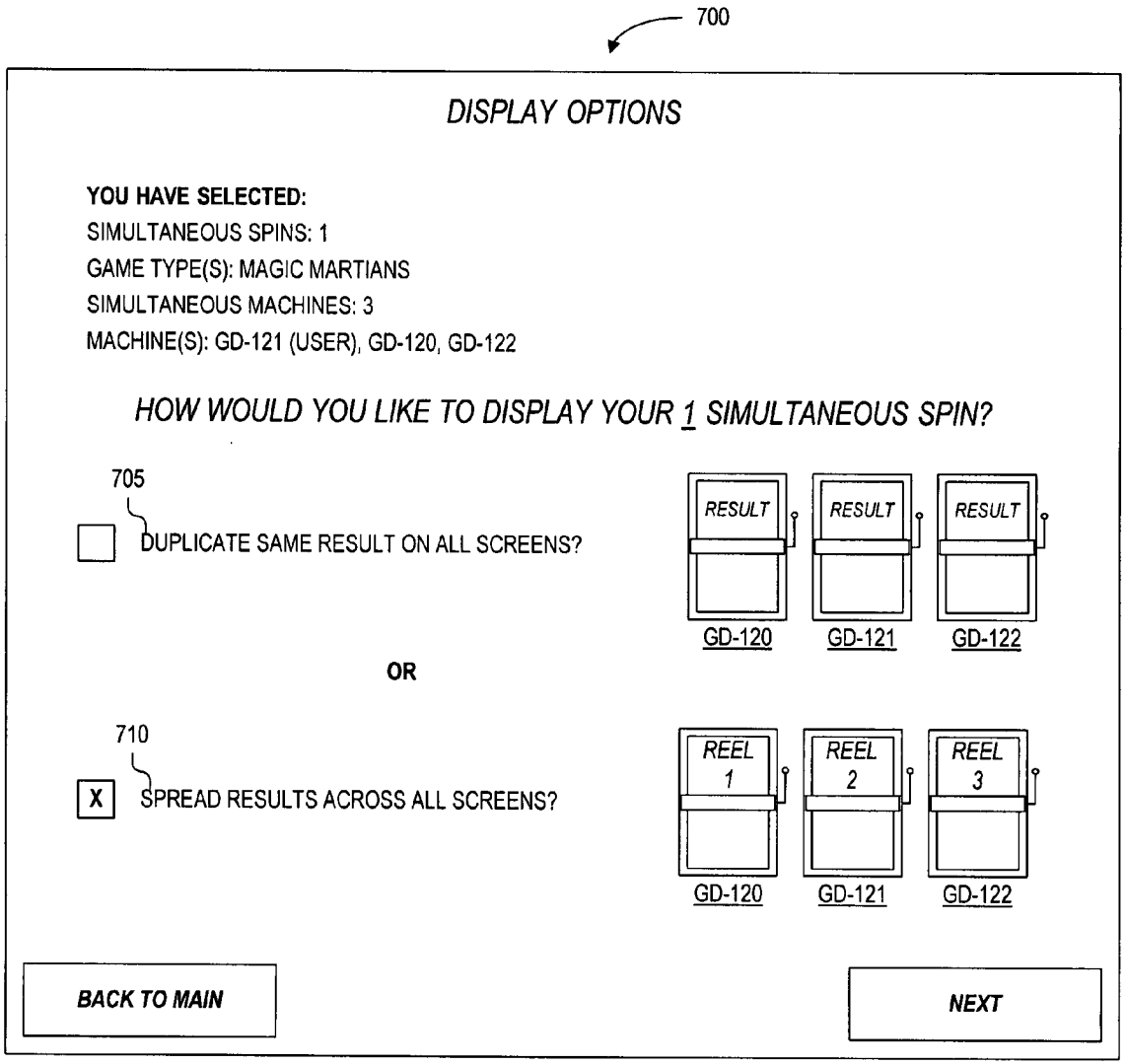
FIG. 7 is a second screen of the user interface of FIG. 6 for customizing the display of game outcomes, in accordance with some embodiments.

The user interface menu 600 facilitating the configuration of multi-machine game play may also provide a display option menu allowing the player to customize the presentation of game outcomes. Turning to FIG. 7, a display option screen 700—which may be part of the user interface menu 600—allows the player to select how game outcomes are presented on the video display. For example in one embodiment with grouped gaming devices, the player may select to have a game outcome divided among all three video displays (i.e., using all three video displays to present a single image) 710. In this embodiment, the display screens of the gaming devices may work in unison to provide a variety of different graphical presentations of game outcomes. Alternatively, the player may decide to separately present each game outcome on a separate video display 705.

Figure 8:
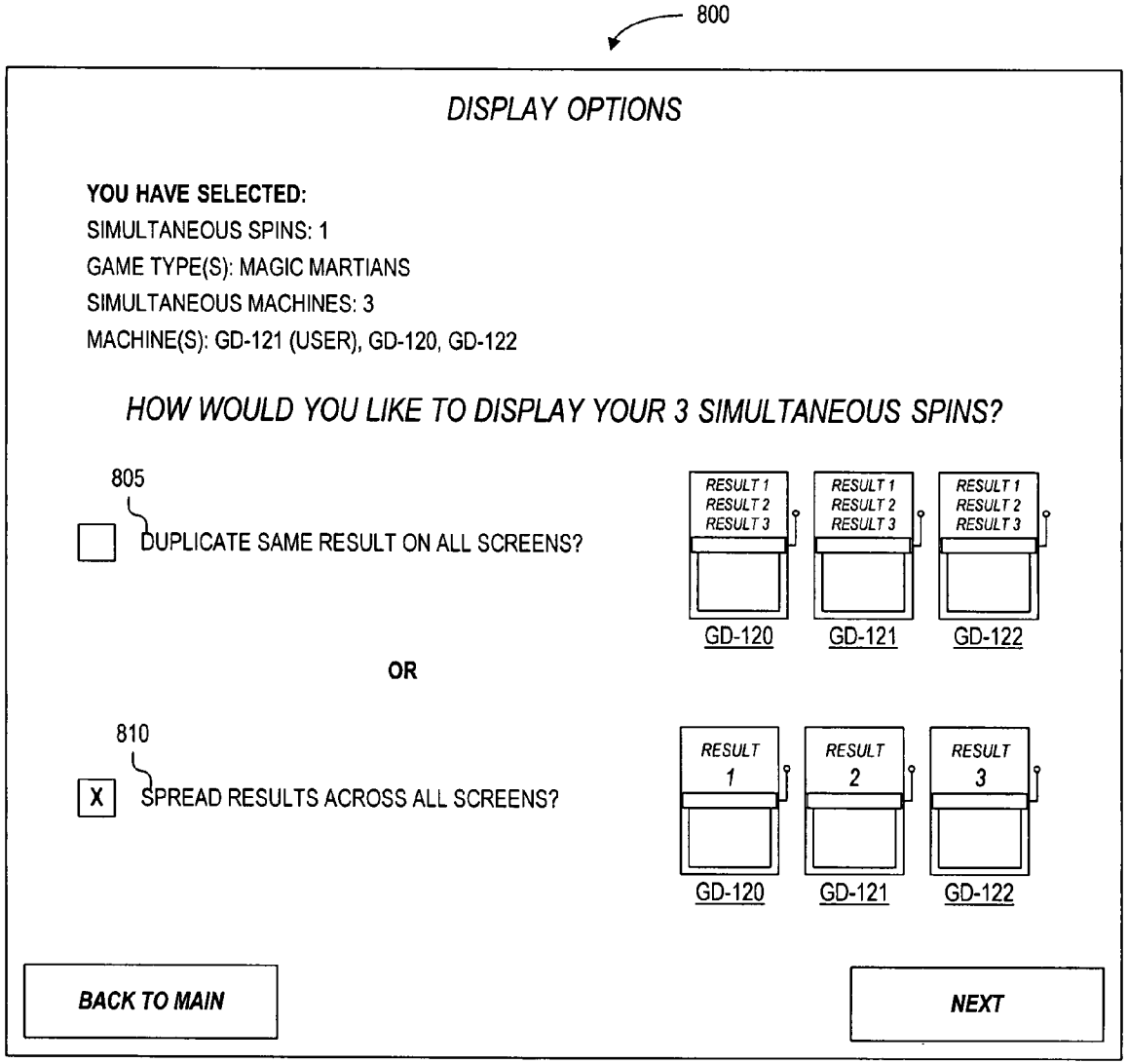
FIG. 8 is a second screen of the user interface of FIG. 6 for customizing the display of multiple game outcomes, in accordance with some embodiments.

In another embodiment, discussed above, the player may elect to receive two simultaneous spins. In this embodiment, the presentation format could provide the same choices as described above, except that both outcomes are simultaneously viewable as shown in FIG. 8. In one embodiment, the player may elect to have the results of the game spread across all the video displays as a single image 810. In still another embodiment, the player may select to have two game outcomes displayed on each of the gaming devices 805.

For example, a player may spread out a three reel slot outcome such that the leftmost gaming device displays the first reel, the middle gaming device displays the second reel, and the rightmost gaming device displays the third reel. A player may allocate more or less than three reels across more or less than three gaming devices. Further, players can allocate indicia other than reels/symbols, such as playing cards, columns of the bingo card, sections of the roulette table, etc. It should be understood, however, that the types of wagering games controlled may include a mix of different types of games and do not require that the wagering games be related. For example, a controlling gaming device with a slot type game may control two video gaming devices having video poker games. For video poker, in one embodiment, the player may be assisted with auto play mode that determines selections for the player. Accordingly, the gaming devices may maintain a degree of synchronization that might not otherwise be available if the player were to make discard selections.

Certain selections may not be available because of size limitations of the video display, or other restrictions, that require the gaming device to override (or simply not allow) the selections. In other embodiments, the types of presentations available for game outcomes may be narrowed as various options are precluded by prior selections.

In another embodiment, a player may determine the positioning of various game outcomes on one or more video displays. This may include not only the relative position of each of the game outcomes on the video display, but also for example, the display size of each of the game outcomes.

In addition to summarizing the presentation of the game outcomes on a plurality of different video displays associated with individual gaming devices, the player may also customize the presentation of the game. For example, a player may select types of reel symbols, colors, and game themes. In addition, a player may have preprogrammed player specifications into a database (e.g., a player tracking database) to provide specific instructions that the gaming device may access to customize game play.

Figure 9:
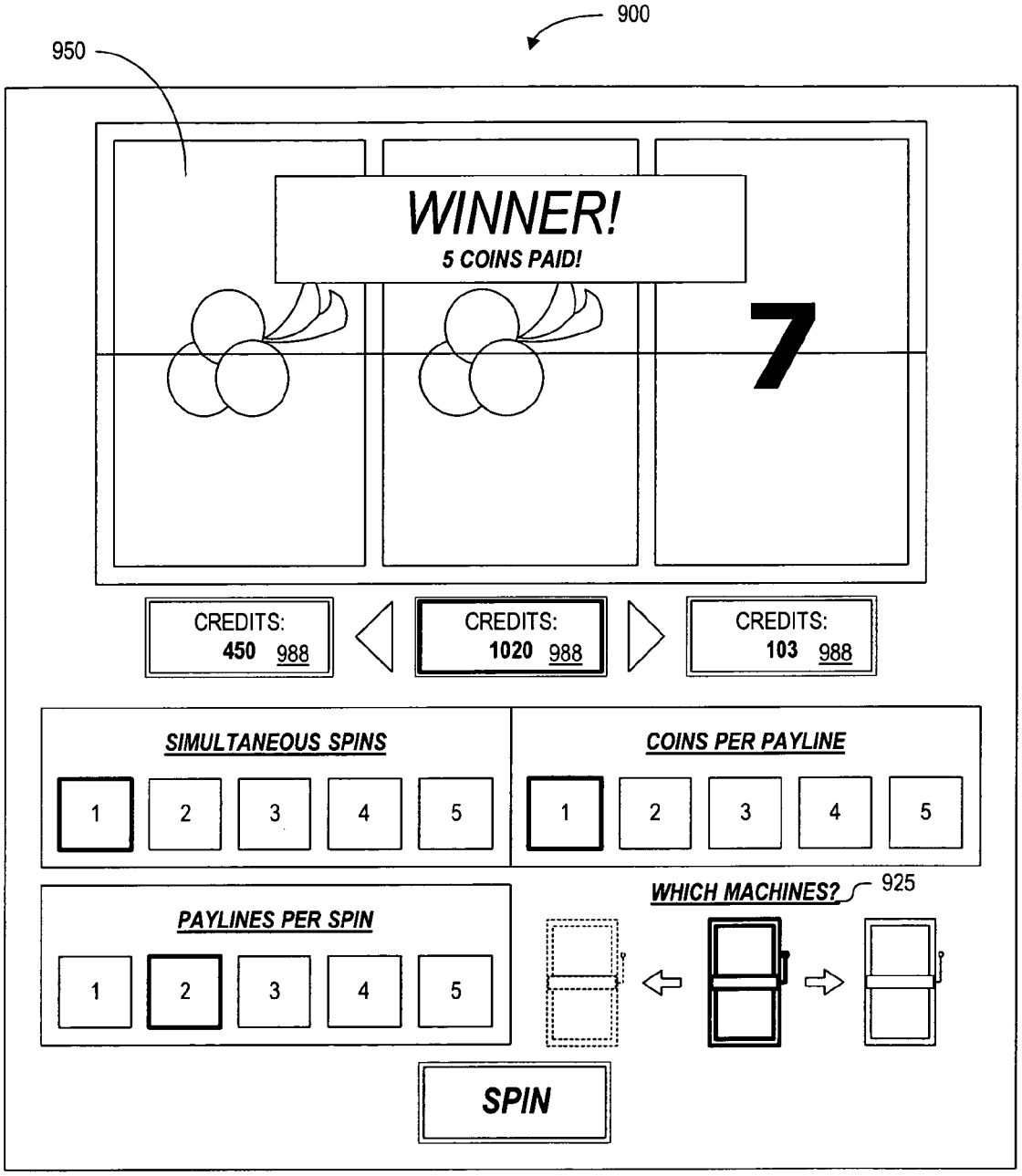
FIG. 9 is an exemplary illustration of a video display of the gaming device of FIG. 1 illustrating a game outcome, in accordance with some embodiments.

Turning to FIG. 9, an alternative exemplary embodiment is illustrated of the video display of the controlling gaming device during game play. This alternative embodiment of the user interface may be always available to the player. The controlling gaming device video display 900 has a gaming device indicator 925 that signifies the gaming device from which information provided on the video display corresponds. In this example, the controlling gaming device in the center is signified by the gaming device indicator 925. In addition, the credit meter 988 corresponding to the signified gaming device is also signified. The video display 900 may also display the game outcome 950 obtained for the signified gaming device. In addition, the video display 900 may also display the number of activated pay lines, the wager per pay line, etc. for each of the controlled gaming devices and controlling gaming device.

In some embodiments, a plurality of credit meters may be established for each of the controlled gaming devices, as well as the controlling gaming device as shown in FIG. 9. Additional credit meters 988 are also presented which correspond to the controlled gaming devices. Accordingly, a player is able at a glance to determine the relative success of each of the gaming devices. In another embodiment, a single credit meter may be used. In some embodiments, a positive balance may be required to remain eligible to control the controlled gaming devices.

Figure 10:
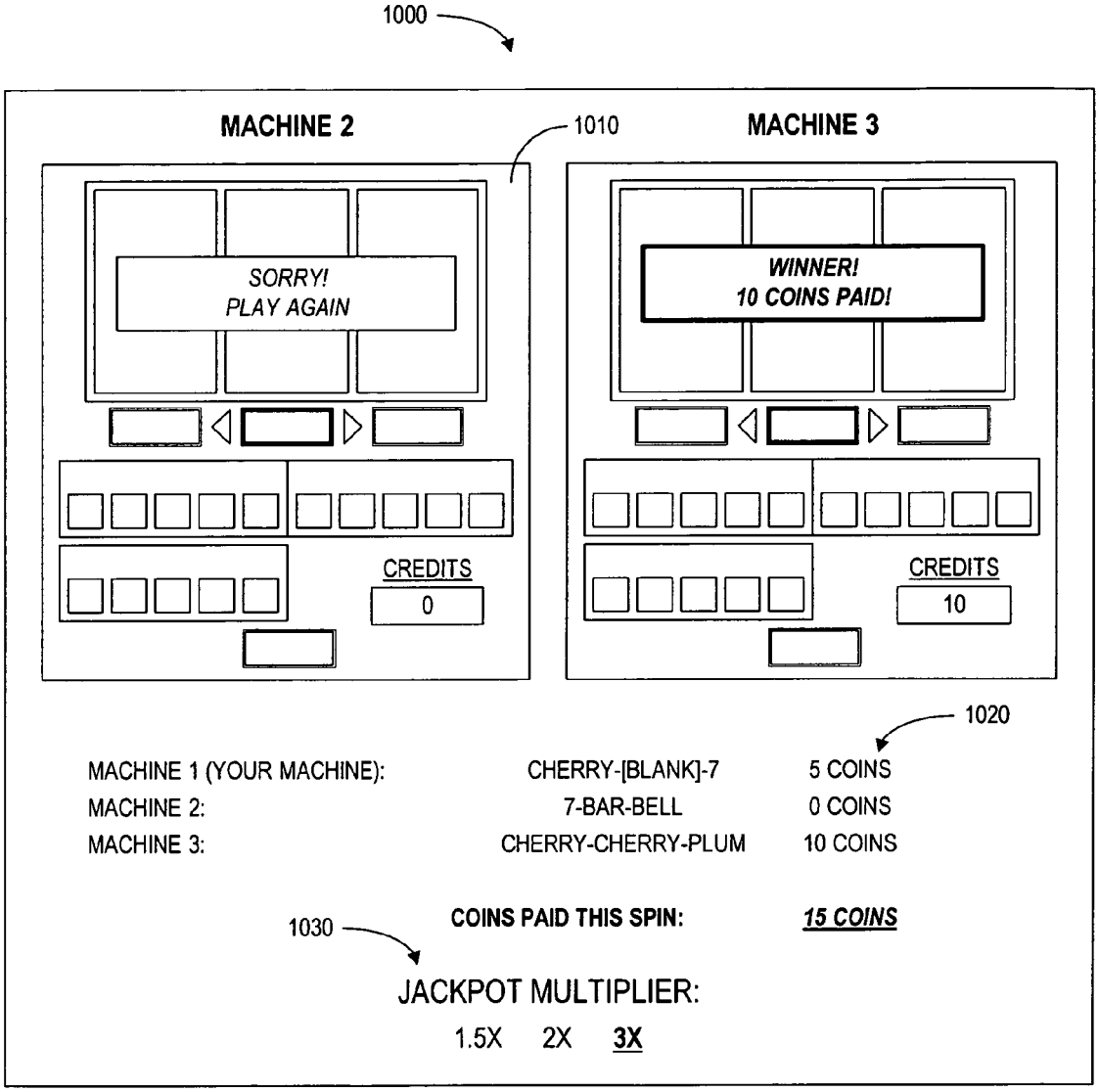
FIG. 10 is an exemplary illustration of a video display of a summary table of the game outcomes received from a plurality of gaming devices, in accordance with some embodiments.

Turning to FIG. 10, at the conclusion of the simultaneous spins, a summary screen 1000 may be displayed on the controlling gaming device to facilitate the player's recognition of the game outcomes received. This may include, in one embodiment, displaying each of the game outcomes as a reduced image 1010 on the video display. In addition in one embodiment, a summary table 1020 of the wager amounts, the payout amounts (i.e., awards), and any other statistical information desired to help the player quickly grasp the game results. In addition, the summary screen 1000 may provide meta-game information 1030 (e.g., bonus multipliers)

Determining Selectable Gaming Devices

Not all the gaming devices on the gaming floor may be selectable by a controlling gaming device. For example, in one embodiment, selectable gaming devices may only be available from gaming devices located in a bank of gaming devices. Banks of gaming devices are generally supplied by the same manufacturer and are often under the supervision of a bank controller (a type of server). Consequently, the selection and interaction of the gaming devices in the bank can be configured and controlled by the bank controller (which may perform as a server in some embodiments). Alternatively, in other embodiments, a server may be used to implement the configuration and interaction of gaming devices whether or not they are in a bank of gaming devices. In still other embodiments, gaming devices may be linked to establish peer-to-peer communications.

In other embodiments, selectable gaming devices may only be allowed from adjacent gaming devices. This may be necessitated by game play mechanics of the game presented by these gaming devices. For example, a player may be required to view the game display of each of the multiple gaming devices under the player's control in order to play the game.

In another embodiment, selectable gaming devices may be limited by the time of day, the day, the week, etc. For example, players may only be allowed to play multiple gaming devices during slow business periods (i.e., off-peak hours). Alternatively, special periods of time may be set aside during the week to allow players to use multi-machine game play.

In still another embodiment, the availability of multi-machine game play may be determined in real-time as a function of business activity. For example, if business is extremely active, multi-machine game play may not be available. This concept may be further refined to evaluate wagering activity on particular types of gaming devices, or banks of gaming devices, to determine whether to offer multi-machine game play.

In another embodiment, the selectable gaming devices may be limited by their "popularity." Some gaming devices may be in high demand. Allowing players to play multiple gaming devices while other players may be forced to wait until such a gaming device becomes available is generally a poor business practice. Consequently, popular games may not be selectable in certain embodiments. The popularity of the game may be statistically quantified based on total coin in over a recent time period, percentage of time the gaming device is in use, and the number of repeat players to a particular gaming device or game. These statistics may be used to create a hierarchical popularity ranking of the gaming establishment's gaming devices.

Of course practical limitations exist that would preclude the selection of the gaming device. For example, in some embodiments, a player would not be able to select a gaming device already in use. Several different criteria, or groups of criteria, may be used to determine whether a gaming device is in use. For example, a gaming device that has a credit balance, an inserted player tracking card, recent player wagering activity, or an indication from a sensor indicating the proximity of a player to the gaming device may be excluded from selection.

In one embodiment, a player may be limited to the number of gaming devices under the player's control. For example, a gaming establishment may determine that a player may control up to three gaming devices. The limit on gaming devices may also be a function of the type and/or popularity of the game being played. For example, certain games may have a game play mechanic that does not lend it to players that have more than two or three gaming devices under their control.

In another embodiment, a player status may determine whether multi-machine game play is available. For example, if a player is not a member of a player loyalty club, multi-machine game play may be refused or limited. Alternatively, in another embodiment, a player may require a threshold wagering activity level (e.g., as determined by player-tracking) to become eligible for multi-machine game play.

Another form of status may be reflected in the player's ability to win certain game outcomes that qualify the player for multi-machine game play. For example, a player may be required to win a bonus event before being allowed multi-machine game play.

In another embodiment, the wager amount may determine whether not a player is eligible for multi-machine game play. For example, a player controlling more than one gaming device may be required to place maximum bets (e.g., maximum bet on all pay lines). Alternatively, a player may be required to maximum bet a specified number of times before qualifying for multi-machine game play—and then still be required to place maximum bets to remain eligible in some embodiments.

Related to this concept, in another embodiment a player may be required to provide a fee to access multi-machine game play. For example, a flat fee may be imposed to allow a player to activate multi-machine game play. This flat fee is not a wager; it merely allows the player to select multi-machine game play. In another embodiment, a variable fee based on the wager amount may be imposed for electing multi-machine game play. In addition, in one embodiment, any combination of flat and variable fees may be imposed.

In one embodiment, a selectable gaming device may signal its availability to a player by providing either an audio offer from the gaming device speakers or a displayed offer on the gaming device's video display. The server or the adjacent gaming device itself may initiate the offer. Rules may be established for determining when to initiate an offer. For example, and offer may be initiated when one gaming device is being used and the adjacent gaming device is idle. In another embodiment, the offer may also be initiated when a player tracking card is in one of two adjacent gaming devices. In still another embodiment, if the utilization rate of the gaming devices (either adjacent or in general) is below a threshold, an offer may be initiated to allow players to control multiple gaming devices.

Enhancements for Multi-Machine Game Play

Regardless of whether a multi-machine game play requires an additional fee, minimum wager amounts, or specified player status requirements, a player participating in multi-machine game play, in one embodiment, may receive additional benefits that may offset these costs. Accordingly, some percentage of the fees may be returned to the player as a benefit to the player for playing multiple gaming devices. Furthermore, in those embodiments that require fees, the collection of fees may help offset (or offset) increased payback percentages. In fact, the fees collected may represent a profit to the gaming establishment. For example, in this embodiment, for each dollar fee collected to allow multiple gaming device play, the gaming establishment may payout $0.90 in enhanced awards. These increased payback percentages may be produced, for example, by a meta-game based on a plurality of game outcomes received from a start game actuation (e.g., the game outcome of each gaming device controlled is used to determine a winning game outcome in a meta-game). In some embodiments, fees may not be necessary to provide such benefits to players.

For example, in one embodiment, multi-machine game play may be further enhanced by providing players with increased payback percentages. The increase payback percentage may be attained by providing, for example, more potential winning game outcomes, larger payouts on existing winning game outcomes, or greater probability that winning game outcomes will be produced. For example, a player may become eligible for a jackpot payout for playing more than one gaming device.

In another embodiment, for example, if the player receives three game outcomes and they are all winning game outcomes, the player may be eligible for a bonus multiplier. Alternatively, even a single winning game outcome may be eligible to receive the bonus multiplier if a certain minimum number of gaming devices are controlled. For example, if two gaming devices are controlled, the player is eligible for a 1.5× bonus multiplier on any winning game outcome. If the player is controlling three gaming devices, the player is eligible for a 2× multiplier on any winning game outcome.

In certain embodiments, this notice may also be appropriate where game play mechanics may provide advantages to players participating in multi-machine game play—specifically with respect to community type shared gaming. This provides notice to players regarding the number of competitors and their status in relation to the game.

For example, in a bank of similarly themed gaming devices (such as a board game) each gaming device may be a predetermined member of a group. Collecting each of the gaming devices in a group (through indirect control from a controlling gaming device in the bank) entitles the player to a payout multiplier, bonus, bonus event, or other benefit. In this embodiment, a second player may piggyback on a controlled gaming device and receive the same game outcomes as a first player who is controlling the controlled gaming device.

Alternatively, in another embodiment, a second player may separately and independently play the controlled gaming device apart from the controlling gaming device. Accordingly, the first and second players receive different game outcomes. These gaming devices may also include both a base and bonus game. The bonus game may be driven by game outcomes in the base game. For example, a player may have a marker that is moved from gaming device to gaming device in a linear progression as a function of the base game outcome. The position of a player's marker (i.e., the gaming device which the marker lands on) at the end of the linear progression determines the bonus game outcome. If the player's marker lands on a gaming device that the player controls no penalty is owed. In contrast, if another player controls the gaming device on which the marker lands, a penalty is owed to the controlling player.

In another embodiment, a player that is able to match game outcomes from different gaming devices may be eligible for a scaled bonus. For example, a player that matches game outcomes from two different gaming devices may be awarded a $10 bonus. If the player matches game outcomes from three different gaming devices, the player is awarded a $15 bonus. Another example of a meta-game may be created by collecting symbols from the game outcomes of each of the gaming devices to create a winning symbol combination in the meta-game. For example, in a game having one simultaneous game outcome for each gaming device controlled, if a player is able to collect a cherry from each of the three game outcomes, the player may win an award.

Another meta-game example involves combining the game outcomes from each of the gaming devices to produce an overall game outcome. The overall game outcome is used to determine if a winning game outcome exists in the meta-game. For example, in a video poker embodiment, if two gaming devices are used to receive two individual game outcomes, and together the two individual game outcomes create a straight (e.g., 4, 5, 6, 7, 8, 9, 10, J, Q, K) the player may receive an award. Similarly, in a three-reel slot type gaming device, two such gaming devices may be grouped to create a 6-reel game outcome—in addition to the two three-reel game outcomes. Winning game outcomes from individual game combinations may require, in some embodiments, an additional wager. Methods for linking and sharing game outcomes between gaming devices are described in Applicants' U.S. Patent Publication No. 2003/0224852, filed Apr. 15, 2003, entitled "METHOD AND APPARATUS FOR LINKED PLAY GAMING WITH COMBINED OUTCOMES AND SHARED INDICIA" the entirety of which is incorporated herein by reference for all purposes.

In addition to monetary bonuses, multi-machine game play may also provide additional or enhanced player tracking points. For example, a multiplier may be applied to player loyalty points earned through multi-machine game play.

In addition to enhanced payouts, multi-machine game play may also provide intangible benefits to the player. For example, the video displays of each of the controlled and controlling gaming devices may be grouped together to produce a single game display that presents a single image (i.e., each of the video displays presents a portion of the image). This type of display may provide greater entertainment value to the player by providing a widescreen effect (multiple screens may "combine" to form one display).

Maintaining Control of Multi-machine Configuration

After a player sets up and executes a start game outcome on the controlling gaming device, the controlling gaming device (or a gaming server, and/or a controller in some embodiments) evaluates whether the controlling gaming device is eligible to retain control over the controlled gaming devices. In one embodiment, control over the controlled gaming devices exists until the game outcomes are provided. In another embodiment, the player may release control of the gaming device by pressing a button on the controlling gaming device or user interface. In another embodiment, control over the currently controlled gaming devices is maintained provided the player maintains a credit balance on each of the controlled gaming devices (which may be indicated by separate credit meters for each of the controlled gaming devices on the controlling gaming device video display).

In some embodiments, control may be predicated upon a minimum number of wagers per-unit time. A player may establish a credit balance on a number of controlled and controlling gaming devices. For example, in one embodiment, a player may establish a balance at a controlling gaming device and then, using a user interface of the controlling gaming device to indicate how the balance is to be allocated to the controlled gaming devices. In a similar embodiment, the controlling gaming device becomes the single credit pool from which wager amounts are deducted for both the controlling and controlled gaming devices as wagers are placed. In another embodiment, the player may be required to insert currency into the controlled and controlling gaming devices.

Between game plays, a player at a controlling gaming device may lose control of the controlled gaming device. For example, in one embodiment, a player may lose control over a gaming device when another player establishes a balance at the controlled gaming device. The controlling player must then find/select another gaming device to control to continue multi-machine game play.

In one embodiment, even if the controlling gaming device does not lose control over the controlled gaming device, another player may piggyback on the game outcomes received by the controlled gaming device. For example, another player may establish a credit balance on the controlled gaming device, select a wager amount, and receive whatever game outcomes that are determined for the controlled gaming device by the game play created by the controlling gaming device. This second player passively watches the outcomes, but is rewarded for any winning game outcomes provided a credit balance is maintained from which wagers may be drawn. This allows the gaming establishment to potentially achieve greater than 100% utilization of the gaming devices on its floor. In this embodiment, certain peripheral devices that would otherwise be locked out (e.g., the wager acceptor) are now available for the secondary player to register a wager on the game outcomes created on the controlled gaming device.

In a related embodiment, similar to piggybacking, a controlled gaming device may be played simultaneously by a first player from a controlling gaming device and by a second player at the controlled gaming device. The game outcomes received by both players are separate and independently obtained. The second player playing on the controlled gaming device, however, may view his own game outcomes as well as the outcomes of the player at the controlling gaming device.

Conclusion

Although only a few wagering devices have been discussed, it should be appreciated that any type of gaming device, may be grouped together under the control of a single gaming device. Further, these gaming devices are not limited to the embodiments described (i.e., video gaming devices, such as video slot machines and video poker machines), but can also be applied to other types of gaming devices, such as video roulette machines, video blackjack machines, and the like. Furthermore, it is also possible to employ electromechanical gaming devices such as gaming devices with mechanical reels that determine game outcomes as another embodiment that may use the methods and apparatus discussed herein.

Thus, while the present invention has been described in terms of certain embodiments, other embodiments that are apparent to those of skill in the art are also intended to be within the scope of the present invention. Accordingly, the scope of the present invention is intended to be limited only by the claims appended hereto.

What is claimed is:

1. A method of operating a gaming system, said method comprising:

enabling a player to wager on a first play of a first game of a first gaming device;

enabling the player to provide at least one non-wager input at the first gaming device to:

(a) select a second, different gaming device, (b) cause the second gaming device to accept control from the first gaming device, said accepted control being based on said at least one non-wager input, and (c) control a first play of a second game of the second gaming device, said controlled first play of the second game of the second gaming device being in association with the at least one non-wager input provided at the first gaming device;

providing any first award based on the first play of the first game;

providing any second award based on the first play of the second game;

determining any third award based on at least one element of the first play of the first game of the first gaming device and at least one element of the first play of the second game of the second, different gaming device; and providing any determined third award.

2. The method of claim 1, which includes determining at least one game outcome for the first play of the first game and for the first play of the second game.

3. The method of claim 2, which includes causing at least one display device to display the at least one game outcome on both the first gaming device and the second gaming device.

4. The method of claim 3, which includes causing the at least one display device to display a first portion of the at least one game outcome on the first gaming device and displaying a second portion of the at least one game outcome on the second gaming device.

5. The method of claim 2, wherein the at least one game outcome is determined by a server in communication with the first gaming device and the second gaming device.

6. The method of claim 1, wherein enabling the player to provide at least one non-wager input at the first gaming device includes enabling the player to provide a non-wager input at the first gaming device to request a game outcome of the first play of the second game from the second gaming device.

7. The method of claim 1, wherein enabling the player to provide at least one non-wager input at the first gaming device includes sending a signal to the second gaming device to cause a display of a game outcome of the first play of the second game.

8. The method of claim 7, wherein the first gaming device determines the game outcome of the first play of the second game.

9. The method of claim 1, wherein enabling the player to provide at least one non-wager input at the first gaming device includes sending a signal to the second gaming device to cause the second gaming device to randomly generate a game outcome of the first play of the second game.

10. The method of claim 1, wherein the second gaming device includes a plurality of peripheral components, and wherein causing the second gaming device to accept control includes deactivating at least one of the plurality of peripheral components.

11. The method of claim 1, wherein enabling the player to provide at least one non-wager input at the first gaming device to select the second gaming device includes causing a signal to be sent from the first gaming device to the second gaming device.

12. The method of claim 11, wherein causing the signal to be sent from the first gaming device to the second gaming device includes routing the signal to the second gaming device with a gaming server.

13. The method of claim 11, wherein causing the signal to be sent from the first gaming device to the second gaming device includes sending the signal through a peer-to-peer network.

14. The method of claim 1, wherein enabling the player to provide at least one non-wager input at the first gaming device includes enabling the player to provide the at least one non-wager input based on a game program of the first gaming device.

15. The method of claim 1, wherein enabling the player to provide at least one non-wager input at the first gaming device includes enabling the player to provide the at least one non-wager input based on a user interface associated with the first gaming device.

16. The method of claim 15, wherein the user interface enables the player to provide the at least one non-wager input to control the first gaming device.

17. The method of claim 15, wherein the user interface enables the player to provide the at least one non-wager input to control the first gaming device and the second gaming device.

18. The method of claim 15, wherein the user interface includes at least one selected from the group consisting of: a graphical user interface and a pushbutton.

19. The method of claim 1, which includes randomly determining a first game outcome of the first play of the first game and randomly determining a first game outcome of the first play of the second game.

20. The method of claim 19, which includes determining any third award based on a combination of the first game outcome and the second game outcome.

21. The method of claim 19, wherein any third award is a bonus award, and which includes providing any third award as a predetermined function of the first game outcome and the second game outcome.

22. The method of claim 1, wherein enabling the player to provide the at least one non-wager input at the first gaming device to select the second gaming device includes making a random determination and based, at least in part, on the random determination, selecting the second gaming device from among a plurality of gaming devices.

23. The method of claim 1, wherein the second gaming device is positioned adjacent to the first gaming device.

24. A method of controlling a plurality of gaming devices in a gaming network, said method comprising:

configuring each of a plurality of separate gaming devices to accept control from a first gaming device, said first gaming device being distinct from any of said plurality of separate gaming devices;

causing the first gaming device to provide any first award based on a first play of a first game;

causing the first gaming device to send a control signal to at least one of the separate gaming devices, said control signal causing at least one of the separate gaming devices to provide any second award based on a first play of a second game;

determining any third award based on at least one element of the first play of the first game of the first gaming device and at least one element of the first play of the second game of the separate gaming device; and causing the first gaming device to provide any third award.

25. The method of claim 24, further including determining a first game outcome for the first play of the first game and determining a second game outcome for the first play of the second game.

26. The method of claim 24, wherein causing the first gaming device to send the control signal to at least one of the separate gaming devices includes causing the first gaming device to send the control signal to request a game outcome from each of the plurality of separate gaming devices.

27. The method of claim 24, wherein causing the first gaming device to send the control signal to at least one of the separate gaming devices includes causing the first gaming device to send a plurality of control signals to cause each of the plurality of separate gaming devices to display one of a plurality of game outcomes.

28. The method of claim 27, which includes causing the first gaming device to determine the plurality of game outcomes.

29. A method of operating a gaming system, said method comprising:

enabling a player to wager on a first play of a first game of a first gaming device;

causing a different second gaming device to be selected for control by the player;

enabling the player to provide at least one input using an interface of the first gaming device to wager on a first play of a second game of the different second gaming device;

providing any first award based on the first play of the first game;

providing any second award based on the first play of the second game;

determining any third award based on at least one element of the first play of the first game of the first gaming device and at least one element of the first play of the second game of the selected different second gaming device; and providing any determined third award.

30. The method of claim 29, wherein causing the different second gaming device to be selected for control comprises determining one of a plurality of gaming devices based on the at least one input provided by the player using the interface of the first gaming device.

31. The method of claim 29, wherein causing the different second gaming device to be selected for control comprises receiving an indication of at least one desired characteristic of the different second gaming device and automatically selecting the different second gaming device based on the at least one desired characteristic.

32. The method of claim 29, further comprising receiving the wager on the first play of the second game at the first gaming device.

33. The method of claim 29, further comprising providing the second award to the player at the first gaming device.

34. The method of claim 29, further comprising displaying an outcome of the first play of the second game on a display of the first gaming device.

35. The method of claim 29, which includes establishing a communication link between the first gaming device and the different second gaming device to enable the first gaming device to send a signal indicative of the at least one input to the different second gaming device.

36. The method of claim 29, which includes causing the first gaming device to send a first signal indicative of the at least one input to a gaming server, and which further includes causing the gaming server to send a second signal indicative of the first signal to the different second gaming device.

* * * * *